US005854453A

United States Patent [19]

Fujiwara et al.

[11] Patent Number: 5,854,453

[45] Date of Patent: Dec. 29, 1998

[54] SOUND ABSORBING BODY, SOUND ABSORBING PLATE, AND SOUND ABSORBING UNIT

[75] Inventors: Kyoji Fujiwara, Fukuoka; Shinta Yamamura, Kanagawa; Naoyuki Furuta; Tadanori Mizukami, both of Tokyo; Yutaka Tasaki, Kanagawa; Takashi Mikami, Saitama, all of Japan

[73] Assignee: Nitto Boseki Co., Ltd., Fukushima, Japan

[21] Appl. No.: 809,731

[22] PCT Filed: Oct. 9, 1995

[86] PCT No.: PCT/JP95/02067

§ 371 Date: Apr. 9, 1997

§ 102(e) Date: Apr. 9, 1997

[87] PCT Pub. No.: WO96/11464

PCT Pub. Date: Apr. 18, 1996

[30] Foreign Application Priority Data

Oct. 11, 1994 [JP] Japan ..... 6-331337
Jun. 14, 1995 [JP] Japan ..... 7-171465

[51] Int. Cl.[6] ..... E04B 1/82

[52] U.S. Cl. ..... 181/293; 181/295; 181/286

[58] Field of Search ..... 181/284, 286, 181/288, 290, 292, 293, 295, 210, 30

[56] References Cited

U.S. PATENT DOCUMENTS

| | | | |
|---|---|---|---|
| 3,269,484 | 8/1966 | Lighter | 181/293 |
| 4,829,728 | 5/1989 | Castelli | 181/295 X |
| 5,362,931 | 11/1994 | Fries | 181/284 |
| 5,532,440 | 7/1996 | Fujiwara | 181/292 X |

FOREIGN PATENT DOCUMENTS

| | | |
|---|---|---|
| 34-9966 | 6/1959 | Japan . |
| 2-272131 | 11/1990 | Japan . |

*Primary Examiner*—Khanh Dang
*Attorney, Agent, or Firm*—Sixbey, Friedman, Leedom & Ferguson; David S. Safran

[57] ABSTRACT

To provide a sound absorbing structure having a superior sound absorbing characteristic and an external appearance of the sound absorbing structure which does not cause flicker or the like, by disposal, for example, in the front of an air chamber, a plurality of ribs (2*a*) are disposed on one surface of the sound absorbing board body (2), and a plurality of through-holes (3) are provided in basal portions (2*b*) between the ribs (2*a*) to form a porous structure. Concealing materials (5) are provided between the ribs (2*a*) of the sound absorbing board body to conceal the through-holes (3), respectively.

9 Claims, 19 Drawing Sheets

STRUCTURE A

STRUCTURE B

STRUCTURE C

STRUCTURE D

COMPARATIVE EXAMPLE 4

COMPARATIVE EXAMPLE 5

COMPARATIVE EXAMPLE 6

SOUND ABSORBING BODY, SOUND ABSORBING PLATE, AND SOUND ABSORBING UNIT

TECHNICAL FIELD

The present invention relates to a sound absorbing body, sound absorbing board, and sound absorbing unit disposed on a surface of a sound absorbing structure in the use of sound-proof walls, tunnel interior walls, and so on in the field of indoor acoustic design for ceilings and wall surfaces and in the field of outdoor noise control.

BACKGROUND ART

Heretofore, fiber mat boards such as asbestos boards, glass wool boards, etc. are used as sound absorbing boards provided on ceilings, wall surfaces, and so on. These fiber mat boards have a disadvantage that these boards are inferior in sound absorbing property in a low frequency band, while they have a sound absorbing effect in middle and high tone bands.

Therefore, an arrangement of a sound absorbing board in which a porous structure of a flat board with a large number of through-holes formed therein is provided in the front of an air chamber is known as a sound absorbing structure excellent in sound absorbing property in a low frequency band.

However, the conventional porous structure sound absorbing board has a problem as follows. Since the board has a shape in which a large number of holes which open in a plane are formed, these holes are visible from the outside when the board is disposed to a ceiling or wall surface so that a visual point of a person cannot come on a wall surface and an unpleasant feeling is given to the person by flicker. Furthermore, there is a limitation in design because the structure has such a simple shape in which only a large number of holes are formed to open in a plane. Furthermore, there is another problem that the large number of holes are stained to make the external appearance poor or to make the sound absorbing property deteriorate.

The present invention has an object to provide a sound absorbing body having a porous structure which is disposed in the front of an air chamber so as to form a sound absorbing structure with a good sound absorbing property, and which can provide a good external appearance without causing visual flicker.

Another object of the present invention is to provide a sound absorbing board in which while a porous structure is provided with a large number of through-holes, those holes can be prevented from being stained or choked.

DISCLOSURE OF THE INVENTION

The above-mentioned object of the present invention can be achieved by a sound absorbing body comprising:

a sound absorbing main body formed almost in the shape of a plate;

a plurality of ribs formed convexly at predetermined intervals on a front surface of the sound absorbing main body for reinforcing the sound absorbing main body, each of the ribs having a desired cross-sectional shape;

through-holes formed through the sound absorbing main body from its front surface to its back surface correspondingly to the respective ribs; and concealing materials disposed between the ribs on the front surface of the sound absorbing main body for concealing the through-holes.

It is preferable to make the ribs integrally with the sound absorbing main body.

Further, the above-mentioned object of the present invention can be achieved by a sound absorbing board comprising:

a sound absorbing board body formed almost into a substantially flat plate;

a plurality of rigs provided on a front surface of the sound absorbing main body for reinforcing the sound absorbing main body;

a plurality of through-holes disposed at a base portion between the ribs provided on the sound absorbing main body; and concealing materials disposed on the front surface of the sound absorbing main body for concealing the through-holes.

It is preferable to make the height of the upper surface of the concealing materials not higher than the height of the upper surface of the ribs respectively.

The above-mentioned object of the present invention can be achieved by a sound absorbing board characterized by comprising:

a sound absorbing board body formed into a substantially flat plate;

a plurality of ribs provided on a front surface of the sound absorbing board body for reinforcing the sound absorbing main body, each of the ribs having a cross-sectional shape widened toward its top end; and a plurality of through-holes formed through the sound absorbing board body to reach its back surface in portions at root ends of the ribs concealed by the top ends of the ribs;

wherein each of the through-holes has a diameter which is longer than width of the root end of each of the ribs and shorter than width of the top end of each of the ribs so that the through-holes open on both sides of each of the ribs.

Further, the above-mentioned object of the present invention can be achieved by a sound absorbing body disposed in the front of an air chamber so as to constitute a sound absorbing structure together with the air chamber characterized by comprising:

a plurality of ribs formed convexly at predetermined intervals on an opposite side to the air chamber so as to form a resonant space which communicates with the air chamber and has a closed upper face to thereby provide a sound absorbing effect due to a resonant effect; and a plurality of through-holes provided in at least one of base portions on a side surface of the respective ribs and on a root portion between the ribs so that the through-holes communicate with the air chamber.

It is preferable to provide sound absorbing material at least on inner or outer surface of the basal portions formed between the ribs.

It is preferable to provide partition walls which are disposed at least on the rear surfaces of the ribs or on the basal portions in order to partition the air chamber located in the back.

It is preferable that each of the ribs has a portion with its sectional shape widened toward the front end.

It is preferable that the volumes of the resonant spaces defined by the ribs are classified into at least two groups.

The above objects can be achieved by a sound absorbing unit characterized by comprising a sound absorbing body as described herein and a back board integrally provided with the sound absorbing body and disposed in the back of the sound absorbing body at a distance so as to define an air chamber therebetween.

(OPERATION)

In the sound absorbing body according to the present invention, a plurality of ribs each having a desired cross-sectional shape are formed convexly at predetermined intervals on a front surface of the sound absorbing main body for reinforcing the sound absorbing main body. Further, through-holes are formed through the sound absorbing main body from its front surface to its back surface correspondingly to the respective ribs. Furthermore, concealing materials are provided between the ribs on the front surface of the sound absorbing board main body for concealing the through-holes.

In the sound absorbing body of an embodiment according to the present invention, a plurality of ribs each having a desired cross-sectional shape are formed integrally with the sound absorbing main body and convexly at predetermined intervals on a front surface of the sound absorbing main body for reinforcing the sound absorbing main body. Further, through-holes are formed through the sound absorbing main body from its front surface to its back surface correspondingly to the respective ribs. Furthermore, concealing materials are provided between the ribs on the front surface of the sound absorbing main body for concealing the through-holes.

In the sound absorbing board according to another embodiment of the present invention, a plurality of ribs are formed on a front surface of the sound absorbing board main body for reinforcing the sound absorbing main body. Accordingly, for example, when such a sound absorbing board is attached in the front of an air chamber so as to constitute a sound absorbing structure, if the sound absorbing board main body is attached with its surface on which the ribs are formed outside, an appearance in which a number of ribs are arranged side-by-side is provided. Further, concealing materials are provided between the ribs on the front surface of the sound absorbing board main body for concealing the through-holes. Accordingly, no unpleasant feeling given to a person even though the large number of holes are formed. Further, because the sound absorbing board has a porous structure in which a large number of through-holes are provided, a sound absorbing structure good in sound absorbing property in a low frequency band can be formed by a combination of the porous structure and the air chamber. Further, various external appearances can be provided by appropriately changing the intervals between the ribs and the width of the ribs, so that the design can be changed variously. Further, the plurality of ribs have a reinforcing function, so that the strength of the sound absorbing board can be improved.

Since the concealing materials for concealing the through-holes are provided on the surface on the side on which the ribs are provided in the sound absorbing board main body, the through-holes cannot be seen from the outside and flicker caused by the large number of holes can be prevented greatly so that a good external appearance can be provided. Further, the concealing materials can protect the through-holes to prevent stain or dust from being deposited thereinto, so that the through-holes can be prevented from being choked over a long term.

In the sound absorbing board according to an embodiment of the present invention, the configuration is such that the ribs and the concealing materials are made even in their upper surface or the upper surface of the ribs project beyond the upper surface of the concealing materials because the height of the upper surface of the concealing materials is made to be not higher than the upper surface of the ribs.

In the sound absorbing board according to another embodiment of the present invention, a plurality of ribs each having a cross-sectional shape widened toward its top end are provided on a front surface of the sound absorbing board body for reinforcing the sound absorbing board body, and the board body has a porous structure in which a plurality of through-holes are formed through the sound absorbing board main body to reach its back surface in portions at root ends of the ribs concealed by the top ends of the ribs. Each rib has a cross-sectional shape widened toward its top end, for example, like a reversed trapezoid and the diameter of each through-hole is set to be longer than the width of the root end of the rib and shorter than the width of the top end of the rib so that the through-holes open on both sides of each of the ribs. Accordingly, for example, by attaching the sound absorbing board in front of the air chamber, it is possible to constitute a sound absorbing structure which is superior in sound absorbing characteristic especially in the low frequency area, and by disposing the sound absorbing board in the state that the surface of the sound absorbing board on which the ribs are formed is disposed outside the sound absorbing structure, it is possible to obtain a preferable appearance. Further, the plurality of through-holes communicating with the other surface of the sound absorbing board main body are formed through the sound absorbing board body in portions at root ends of the ribs concealed by the top ends of the ribs. Accordingly, the through-holes are not clearly seen from the outside so that no visual flickering or the like is caused by a number of through-holes and therefore no unpleasant feeling is caused by the flickering.

In the sound absorbing body according to the present invention, when the sound absorbing body is attached to the front of the air chamber to thereby constitute a sound absorbing structure, the plurality of ribs the upper surface of which is blocked become the front surface to thereby obtain an external appearance in which the large number of ribs are disposed. Because the through-holes are formed in side surfaces of the ribs or in the basal portions between the ribs, the through-holes are inconspicuous. Accordingly, there is no flicker caused by the through-holes so that no unpleasant feeling is given to a person.

Further, because the sound absorbing body has a porous structure in which a large number of through-holes are provided, a sound absorbing structure good in sound absorbing property in a low frequency band can be formed by a combination of the sound absorbing body and the air chamber. Furthermore, because spaces among the ribs serve as resonant spaces in this occasion, not only the sound absorbing property is improved but also the sound absorbing structure can be made thin compared with the case where the conventional porous board is used.

Furthermore, because various external appearances can be provided by changing the interval and width of the ribs suitably, the design can be changed variously. Further, because the plurality of ribs also have a reinforcing effect, the strength of the sound absorbing body can be improved.

In a sound absorbing body of the present invention, the aforementioned sound absorbing body further comprises a sound absorbing material which is disposed at least on inner or outer surface of the basal portions between the ribs, by which not only the resonant frequency band can be widened but also the sound absorbing property in a wide frequency band can be improved.

In a sound absorbing material of the present invention, the sound absorbing body further comprises partition walls which are disposed at least on the rear surfaces of the ribs or on the basal portions in order to partition the spaces in the ribs and the air chamber located in the back. Accordingly, a plurality of independent small chambers are formed so that resonant frequencies corresponding to the independent small chambers can be provided, or in other words, a sound absorbing structure having a desired sound absorbing property can be designed easily if the volumes of the independent small chambers are designed to be in values corresponding to required resonant frequencies.

Further, in a sound absorbing body of the present invention, each of the ribs has a portion with its sectional shape widened toward the front end. Accordingly, the effect in which the ribs conceal the through-holes is high, so that a good external appearance is obtained. At the same time, there arises an effect that stain or dust is prevented from being deposited into the through-holes, so that the through-holes can be prevented from being choked for a long term.

In a sound absorbing body of the present invention, the sizes of the ribs are classified into two or more kinds so that the volumes of the resonant spaces defined by the plurality of ribs are classified into at least two groups. Accordingly, a plurality of resonant frequencies can be provided, so that the sound absorbing property in a wide frequency band can be improved.

In a sound absorbing body of the present invention, a sound absorbing unit comprises the sound absorbing body as mentioned above; and a back board integrally provided with the sound absorbing body and disposed in the back of the sound absorbing body at a distance so as to define an air chamber therebetween. Accordingly, a wall surface having a required sound absorbing property can be formed simply by arranging such sound absorbing units, so that a sound absorbing structure can be produced easily on site. In the sound absorbing board and the sound absorbing body according to embodiments of the present invention respectively, the configuration is such that the ribs and the concealing materials are made even in their upper surface or the upper surface of the ribs project beyond the upper surface of the concealing materials because the height of the upper surface of the concealing materials is made to be not higher than the upper surface of the ribs.

BEST MODE OF THE PRESENT INVENTION

The present invention will be described in more detail with reference to the accompanying drawings.

Figure 1:
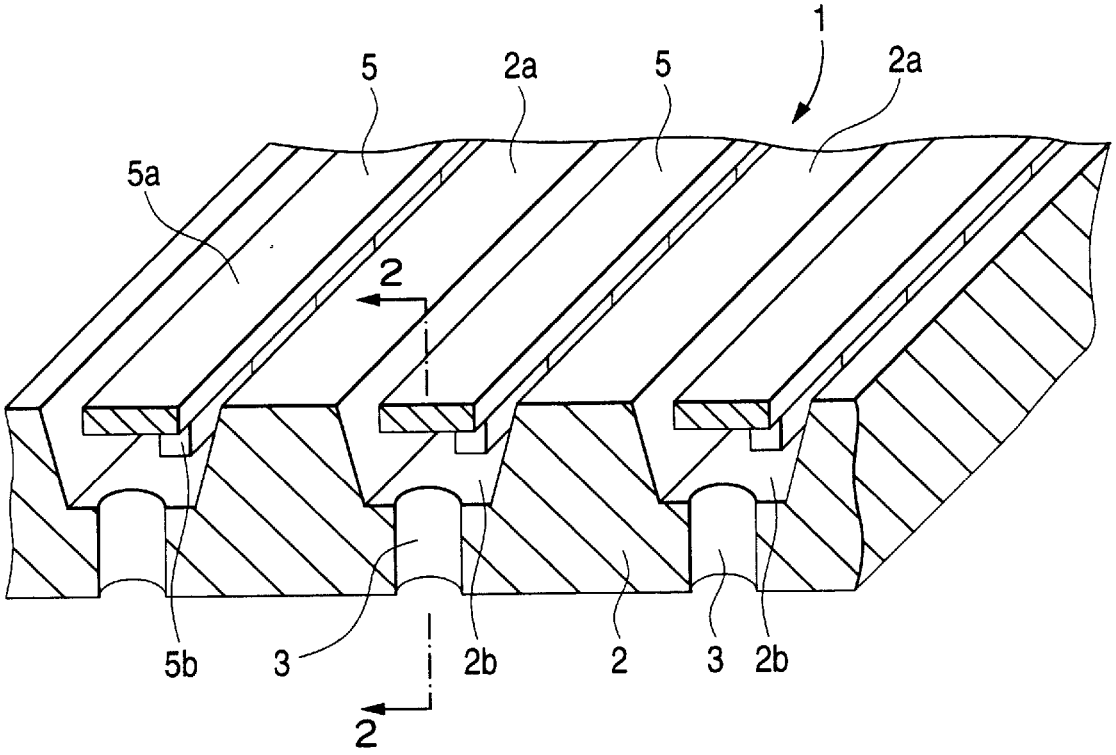
FIG. 1 is a schematic perspective view of a sound absorbing board according to an embodiment of the present invention.
Figure 2:
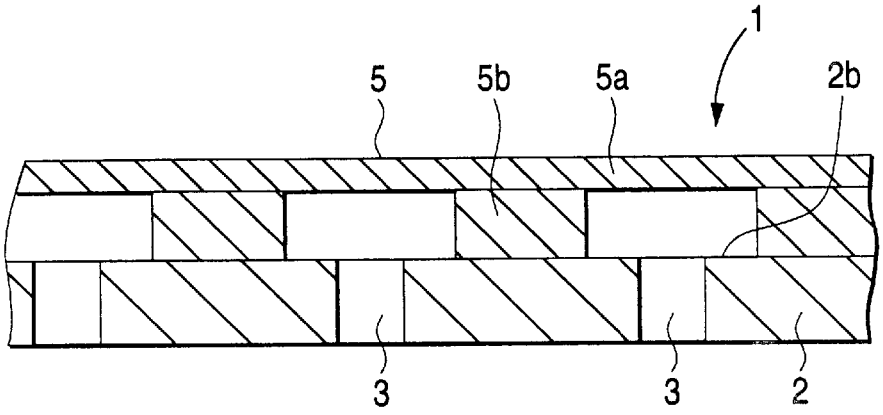
FIG. 2 is a schematic sectional view taken along line 2—2 of FIG. 1 showing the sound absorbing board depicted in FIG. 1.

FIG. 1 is a schematic perspective view of a sound absorbing board according to an embodiment of the present invention, and FIG. 2 is a schematic sectional view of the sound absorbing board taken along line A—A of FIG. 1.

The sound absorbing board designated as a whole by reference numeral 1 has a sound absorbing board body 2 which is a substantially flat plate-like member as a whole. This sound absorbing main body 2 has a plurality of ribs 2*a* provided in parallel to each other on one of the surfaces of the board and has a porous structure in which a plurality of through-holes 3 are provided in basal portions 2*b* between the ribs 2*a*. The sound absorbing board 1 further has concealing materials 5 which are provided between the ribs 2*a* so as to conceal the through-holes 3 respectively. Each of the concealing materials 5 has a long concealing portion 5*a* on the front surface side, and a leg portion 5*b* for connecting the concealing portion 5*a* to the basal portion 2*b* at a position in which there is no through-hole 3 provided.

Figure 3:
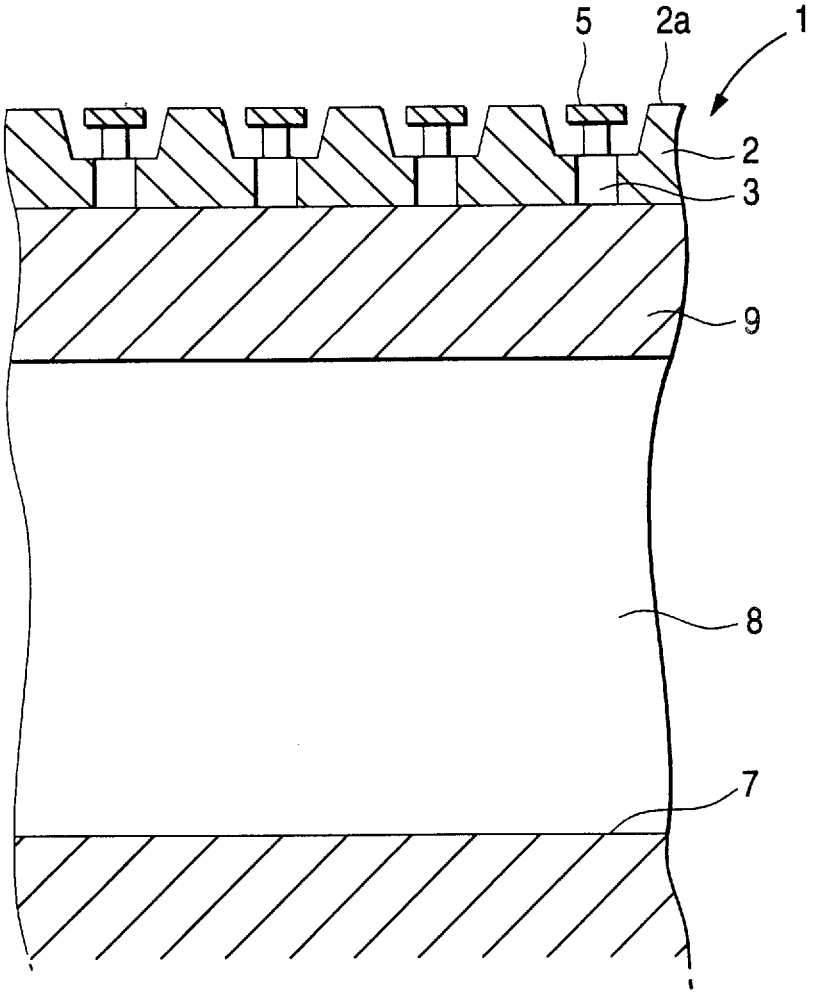
FIG. 3 is a schematic sectional view showing an example of sound absorbing structure configured by using the sound absorbing board depicted in FIG. 1.

FIG. 3 is a schematic sectional view showing an example of the sound absorbing structure constituted by using this sound absorbing board 1. In FIG. 3, the reference numeral 7 designates a wall surface to which this sound absorbing structure is attached; 8, an air chamber; and 9, a sound absorbing material such as glass wool disposed in the front of the air chamber 8. The sound absorbing board 1 is disposed in front of the sound absorbing material 9 so that the ribs 2*a* face on the outside. Accordingly, the sound absorbing board 1 is disposed as the frontmost surface of the sound absorbing structure, so that the rib 2*a* side surface is in a visible state. Incidentally, as the sound absorbing material 9, there may be used not only glass wool but also porous materials such as rock wool, fiber mat material, or the like, film materials such as sail cloth, or the like, and so on.

In the sound absorbing structure configured as described above, the large number of through-holes 3 are not visible even though the large number of through-holes 3 are formed in the surface of the board since the surface on which the ribs 2*a* and concealing materials 5 of the sound absorbing board 1 are disposed, forms an external appearance. Accordingly, there is no flicker caused by the through-holes 3, so that there is formed a stripe-like good external appearance which is such that the ribs 2 and the concealing materials 5 are disposed. Accordingly, not an unpleasant feeling but a good impression can be given to a person who sees the sound absorbing board. Further, because the plurality of ribs 2*a* have a reinforcing effect, the strength of this sound absorbing board is higher than that of the simply flat plate-like sound absorbing board. Accordingly, support members (not shown) for attaching the sound absorbing board 1 to the wall 7 at an interval therebetween to form an air chamber 8 can be simplified. Furthermore, because the concealing materials 5 can prevent stain or dust from being deposited in the through-holes 3, the through-holes 3 can be prevented from being choked over a long term.

In the sound absorbing structure shown in FIG. 3, a sound wave from the outside collides with the sound absorbing board 2 located in the front side and passes through the through-holes 3 into the sound absorbing material 9 and the air chamber 8 located in the back side, so that the sound absorbing material 9 and the air chamber 8 absorb the sound wave by the isothermal change or adiabatic change due to heat transmission. In this occasion, a sound absorbing effect mainly in a low frequency band is obtained by using the through-holes 3 and the air chamber 8 in combination whereas a sound absorbing effect in a middle or high tone band is obtained by the sound absorbing material 9. In this manner, this sound absorbing structure has a sound absorbing effect excellent in a range of from a low frequency band to a high frequency band.

In the sound absorbing board 1 of the aforementioned embodiment, the large number of through-holes 3 formed in the sound absorbing board body 2 are provided to make entrance of sound into the air chamber 8 easy. The numerical aperture, hole diameter, pitch, etc. of the through-holes 3 may be determined taking into account the sound-absorption frequency property based on a combination of the through-holes 3 and the air chamber. Generally, the numerical aperture is preferably in a range of from about 2 to about 20%, more preferably in a range of from about 5 to about 10%. Further, the hole diameter is preferably in a range of about 3 to 15 mm, more preferably in a range of from about 5 to about 7 mm. Further, the hole pitch may be determined suitably correspondingly to the aforementioned numerical aperture and hole diameter ranges.

The width and interval of the ribs 2*a* formed on the sound absorbing board body 2 may be determined taking into account the aforementioned hole pitch of the through-holes 3 so that a good external appearance is provided. Further, the height of the ribs 2*a* may be determined taking into account the reinforcing effect of the ribs 2*a* and the height of the concealing materials 5. Generally, the height of the ribs 2*a* is determined to be preferably in a range of from about 0.5 times to about 2 times, more preferably about 1 time as much as the thickness of the basal portions 2*b*. Not only the trapezoidal shape having a wide bottom portion in the embodiment shown in the drawings but also a rectangular or reverse-trapezoidal shape, or the like, may be used as the sectional shape of the ribs 2*a*. These shapes can be changed suitably to obtain a good external appearance.

The concealing materials 5 are provided to conceal the large number of through-holes 3. Generally, the width of the concealing materials 5 is selected to be larger than the hole diameter of the through-holes 3. Incidentally, the sectional shape, size, etc. of the concealing materials 5 are not limited to the embodiment shown in the drawings, and various changes may be made if entrance of sound wave into the through-holes 3 is not blocked.

Figure 4:
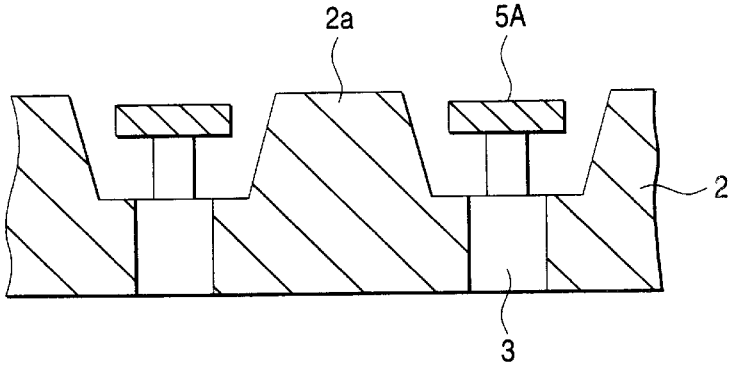
FIGS. 4(*a*), 4(*b*) and 4(*c*) are schematic sectional views showing sound absorbing boards using concealing materials in different shapes respectively.
Figure 4:
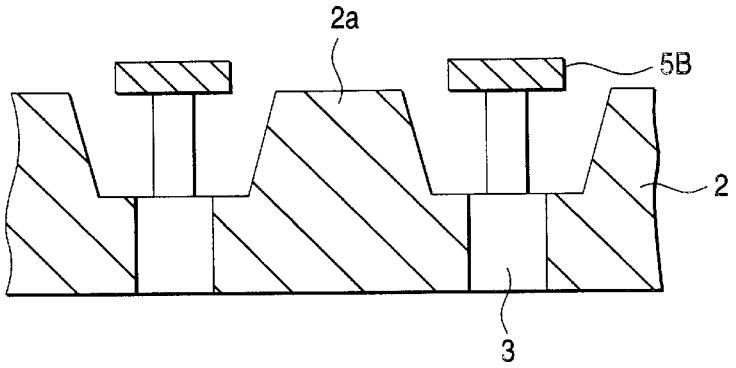
Figure 4:
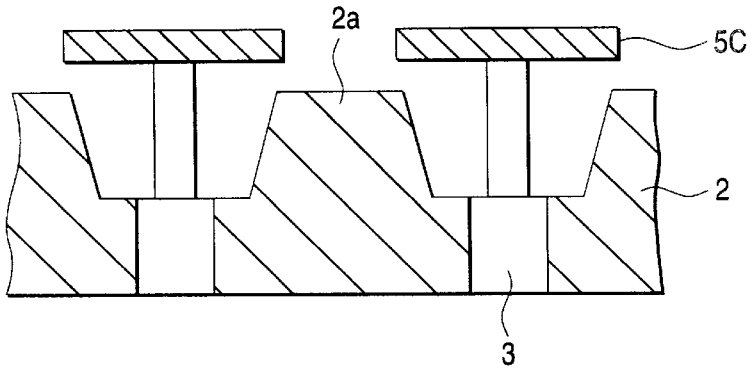

For example, FIG. 4 shows examples of a sectionally T-shaped concealing material. FIG. 4(*a*) shows a concealing material 5A which is formed so as to be lower than the rib 2*a*. FIG. 4(*b*) shows a concealing material 5B which is formed so as to be higher than the rib 2*a*. FIG. 4(*c*) shows a concealing material 5C which is formed so as to be higher than the rib 2*a* and wider than the groove width between ribs 2*a* and 2*a*.

Figure 5:
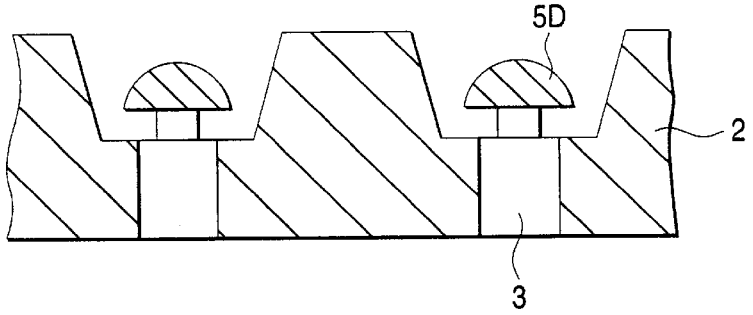
FIGS. 5(*a*), 5(*b*), 5(*c*) and 5(*d*) are schematic sectional views showing sound absorbing boards using concealing materials in different shapes respectively.
Figure 5:
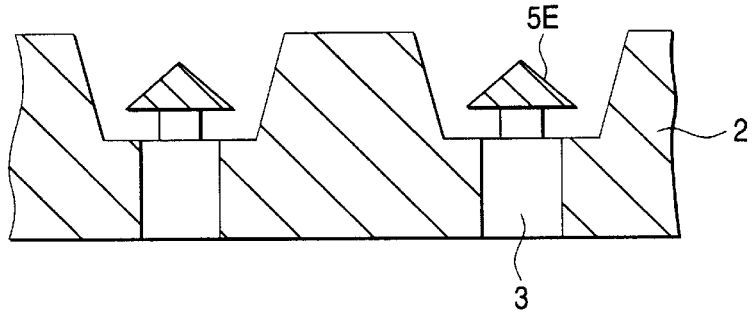
Figure 5:
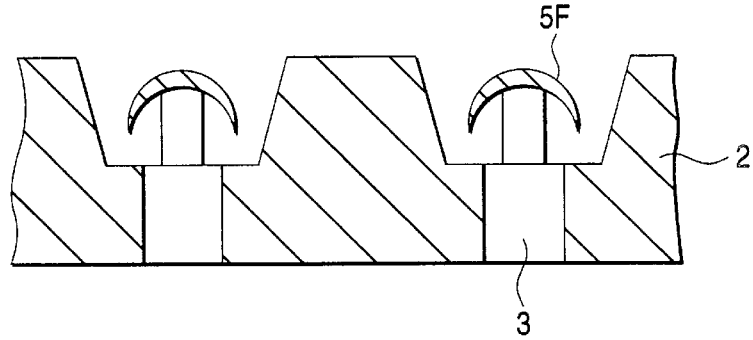
Figure 5:
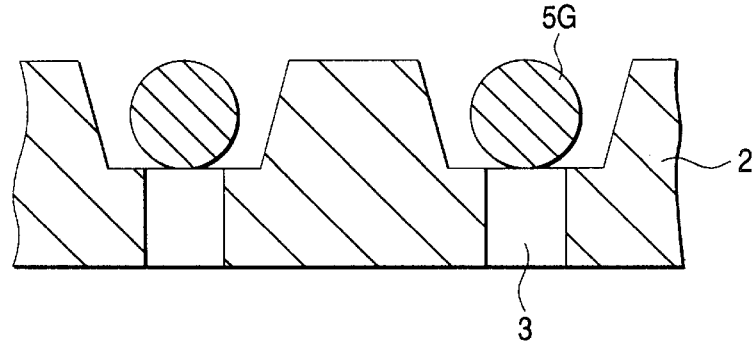

Further, FIG. 5 shows examples of the concealing material different in sectional shape. FIG. 5(*a*) shows a concealing material 5D which has a sectionally semicircular concealing portion. FIG. 5(*b*) shows a concealing material 5E which has a sectionally triangular concealing portion. FIG. 5(*c*) shows a concealing material 5F which has a sectionally arc-like concealing portion. FIG. 5(*d*) shows a concealing material 5G which has a sectionally circular concealing portion.

As described above, although the concealing materials 5 (and 5A to 5G, etc.) are provided to conceal the through-holes 3, they are provided so that entrance of sound wave into the through-holes 3 is not blocked. Therefore, the sectional area of a passage formed between the concealing material 5 and the sound absorbing board body 2 is generally selected to be larger than the sectional area of the through-hole 3.

If the sectional area is selected as described above, the numerical aperture of the sound absorbing board 1 is determined on the basis of the numerical aperture of the through-hole 3, so that the provision of the concealing materials 5 has little influence on the sound absorbing property. Accordingly, not only the sound absorbing property of the sound absorbing board can be determined correspondingly to the design of the through-holes 3 (the design concerning numerical aperture, hole diameter, hole pitch, etc.) but also the shape, size, etc. of the concealing materials 5 can be desirably determined taking into account the external appearance, so that the design can be changed as desired.

Alternatively, the sectional area of the through-holes of the passage formed between the concealing material 5 and the sound absorbing board body 2 may be selected to be smaller than the sectional area of the through-hole so that the numerical aperture of the sound absorbing board 1 can be determined on the basis of the passage formed between the concealing material 5 and the sound absorbing board body 2. In this configuration, the sound absorbing property can be changed correspondingly to the concealing material 5.

The material for the sound absorbing board body 2 of the sound absorbing board 1 is not limited specifically. For example, a material having little sound absorbing effect in itself, such as wood, plastics, etc., may be used, or a fiber mat-like material having a sound absorbing effect, such as asbestos, glass wool, etc., may be used. Further, the same material as that for the sound absorbing board body 2 can be used as the material for the concealing material 5. The sound absorbing board body 2 and the concealing material 5 may be formed from one and the same material or from different materials. Incidentally, when a material having a sound absorbing effect is used as the material for the sound absorbing board body 2 and/or concealing material 5, there is obtained an advantage that the sound absorbing effect is improved more greatly.

Although the aforementioned embodiment has shown the case where the concealing materials 5 are disposed for concealing the through-holes 3 formed between the ribs 2*a*, 2*a*, the concealing materials 5 can be omitted.

Figure 6:
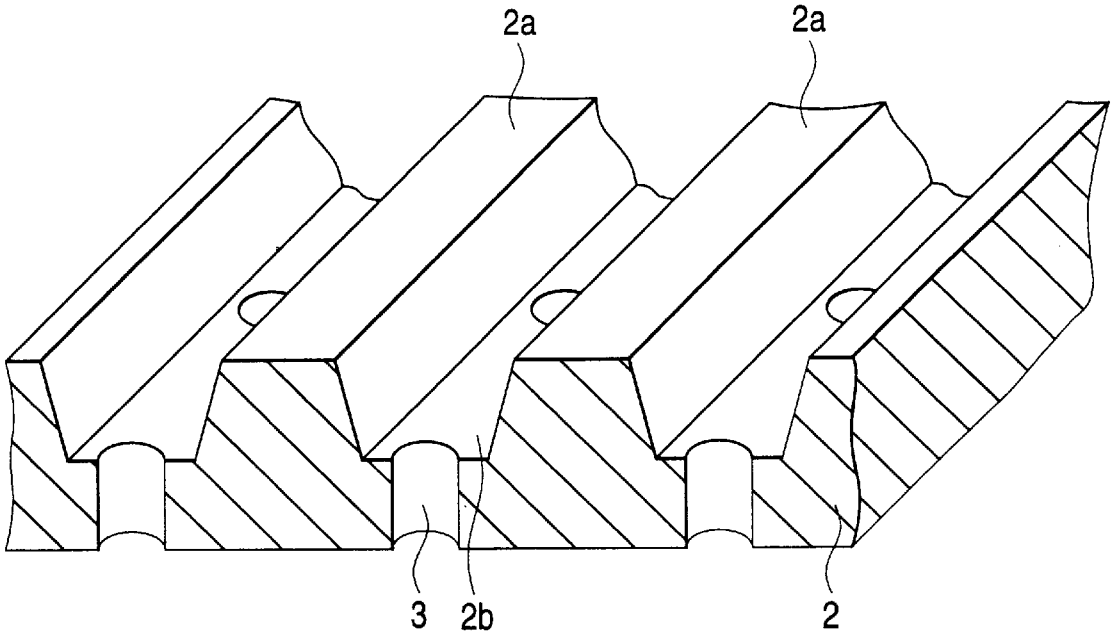
FIG. 6 is a schematic perspective view showing a sound absorbing board according to another embodiment of the present invention.

FIG. 6 shows an embodiment in this case. In FIG. 6, a large number of through-holes 3 are formed in basal portions 2*b* between ribs 2*a*, 2*a* of the sound absorbing board body 2 so as not to be concealed. In this embodiment, the through-holes 3 located in bottom portions of grooves formed between the ribs 2*a*, 2*a* are visible but not so conspicuous because the ribs 2*a* are provided so as to be emphasized. Accordingly, there is no flicker caused by the large number of holes, so that no unpleasant feeling is given.

Figure 7:
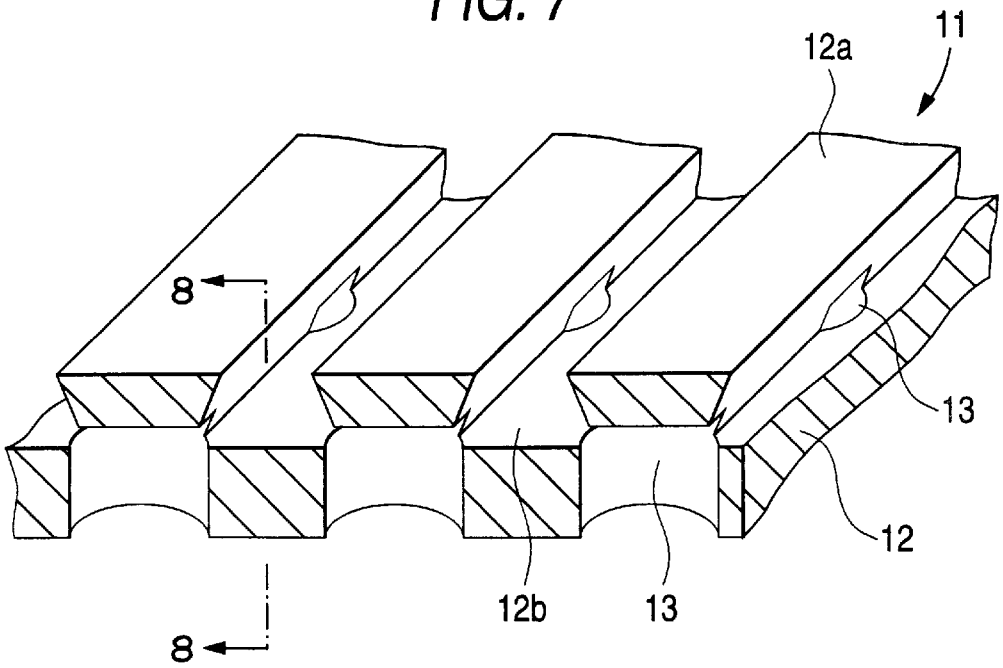
FIG. 7 is a schematic perspective view showing a sound absorbing board according to a further embodiment of the present invention.
Figure 8:
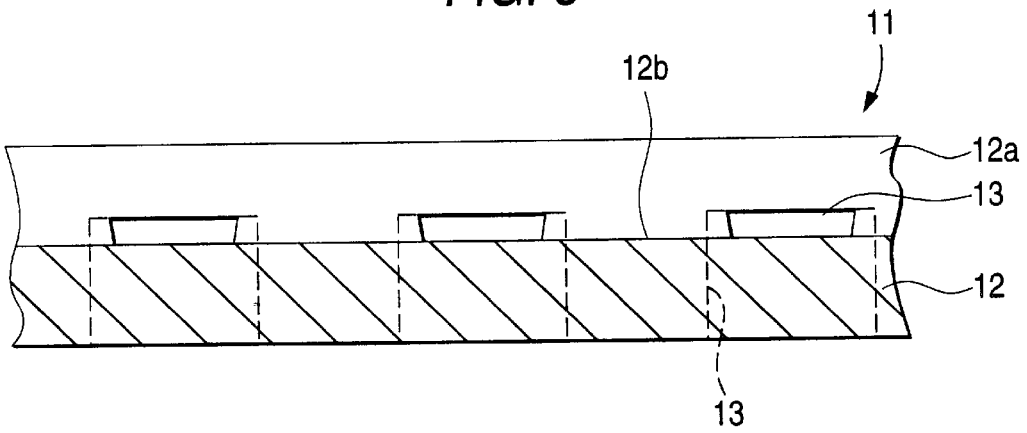
FIG. 8 is a schematic sectional view taken along line 8—8 of FIG. 7 showing the sound absorbing board depicted in FIG. 7.
Figure 9:
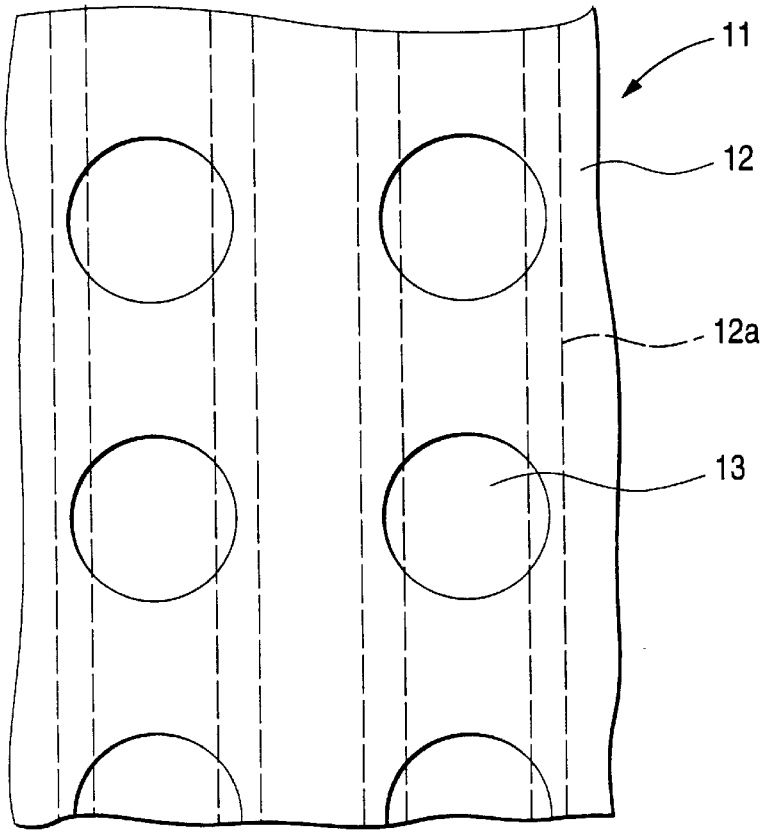
FIG. 9 is a bottom view of the sound absorbing board depicted in FIG. 7.

FIGS. 7 to 9 show a further embodiment of the present invention.

In this embodiment, a sound absorbing board 11 is substantially constituted by only a flat-plate-like sound absorbing board body 12 as a whole. This sound absorbing board body 12 has a plurality of ribs 12*a* disposed in parallel to each other on one surface of the sound absorbing board body 12, and a plurality of holes 13 formed in basal portions of the ribs 12*a*. Each of the ribs 12*a* has a cross-sectional shape widened toward its top end like a reversed trapezoid as shown in FIG. 7. Each of the holes 13 has a diameter which is smaller than the width of the front end of the rib 12*a* but larger than the width of the bottom portion of the rib 12*a*. Accordingly, the upper end of the hole 13 is opened in a portion which is a portion of intersection between the rib 12*a* and the basal portion 12*b* and which is a portion concealed by the front end of the rib 12*a*, so that there is formed a through-hole which pierces the sound absorbing board body 12 from one side to the other side. Here, the area of the hole 13 opened in the portion of intersection between the rib 12*a* and the basal portion 12*b* is determined to obtain a numeral aperture required for a desired sound absorbing property.

Incidentally, the hole 13 is not limited to the case of a hole having a large diameter so as to be opened on opposite sides of one rib 12*a* as shown in the drawings. A hole having a small diameter may be used so as to be opened on only one side of the rib 12*a*. In this case, the hole having a small diameter may be disposed only in one side of or in each of the opposite sides of the rib 12*a*.

The sound absorbing board 11 of this embodiment can be also used instead of the sound absorbing board 1 in the sound absorbing structure configured as shown in FIG. 3, so that a sound absorbing structure good in sound absorbing property in a low frequency band can be formed. In this occasion, by disposing the ribs 12*a* on the outer surface side, a good groove-like external appearance formed from the parallel ribs can be provided so that the holes 13 are invisible from the outside.

Although the above embodiments have shown the case where ribs 2*a*, 12*a* are disposed so as to extend in only one direction, ribs extending in a direction perpendicular to the ribs 2*a*, 12*a* may be further provided at intervals of a suitable distance. Although the above embodiments have shown the case where ribs 2*a*, 12*a* are disposed on only one surface so that the other surface is flat, the other surface is not limited to such a flat surface. For example, ribs may be formed on the other surface. In this case, the sectional shape, direction, etc. of ribs may be selected to be the same as those of the ribs 2*a*, 12*a* formed on one surface or to be different from those of the ribs 2*a*, 12*a*.

Figure 10:
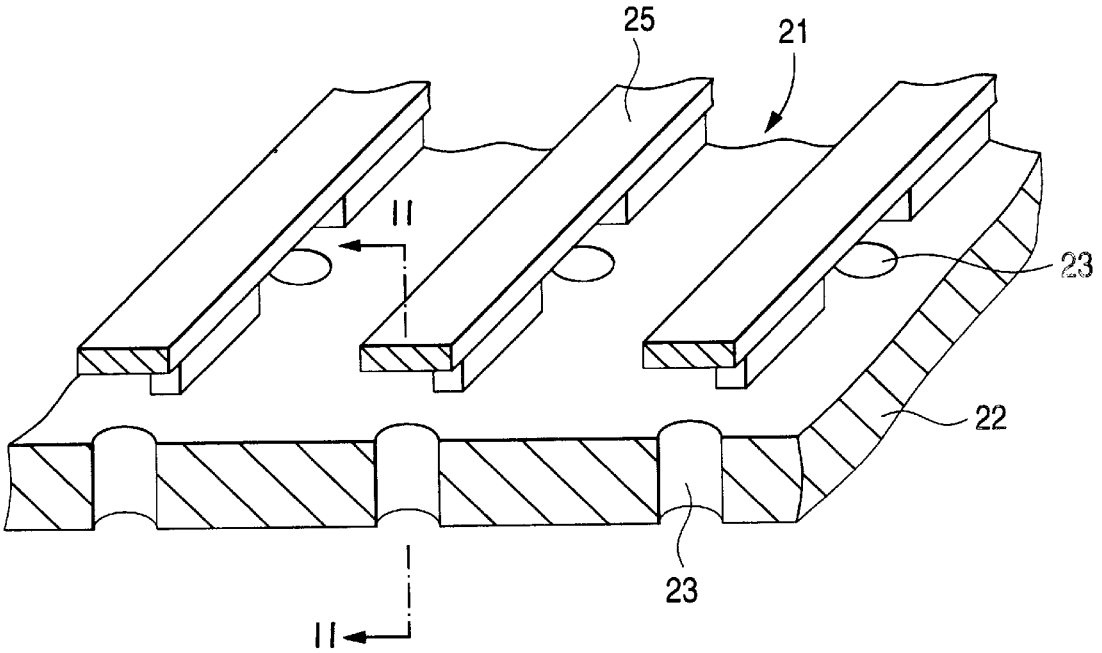
FIG. 10 is a schematic perspective view showing a sound absorbing board according to another embodiment of the present invention.
Figure 11:
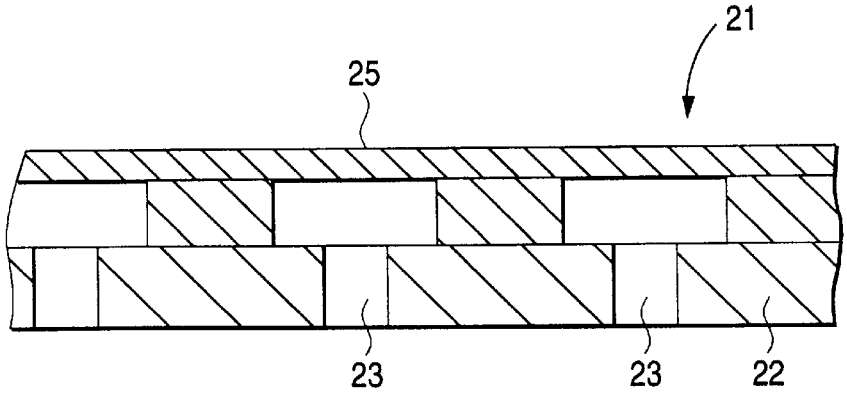
FIG. 11 is a schematic sectional view taken along line 11—11 of FIG. 10 showing the sound absorbing board depicted in FIG. 10.

Next, FIGS. 10 and 11 show a further embodiment of the present invention.

In this embodiment, a sound absorbing board 21 has a simple flat-plate-like sound absorbing board body 22 without any rib, and through-holes 23 which are formed in the sound absorbing board body so as to be disposed as a plurality of rows. Further, a plurality of concealing materials 25 are attached to one surface of the sound absorbing board body 22 so that the rows of through-holes 23 are concealed by the concealing materials 25, respectively.

Similarly to the sound absorbing boards of the other embodiments, the sound absorbing board 21 of this embodiment can be also used instead of the sound absorbing board 1 in the sound absorbing structure configured as shown in FIG. 3, so that a sound absorbing structure good in sound absorbing property in a low frequency band can be formed. In this occasion, by arranging the concealing materials 25 on the outer surface side, it is possible to obtain a groove-like external appearance which is formed from the parallel concealing materials 25 so that the through-holes 23 are not visible from the outside. Incidentally, modifications may be made such that concealing materials or ribs are disposed on a surface opposite to the surface of the sound absorbing board body 22 on which the concealing materials 25 or ribs are disposed.

The materials for forming the sound absorbing board body and concealing materials, the numerical aperture of the through-holes, and so on, in the embodiments shown in FIGS. 6 to 11 are the same as those in the description of the embodiments shown in FIGS. 1 to 5.

The results of measurement of the sound absorbing property are shown as follows.

[EXAMPLE 1]

Figure 12:
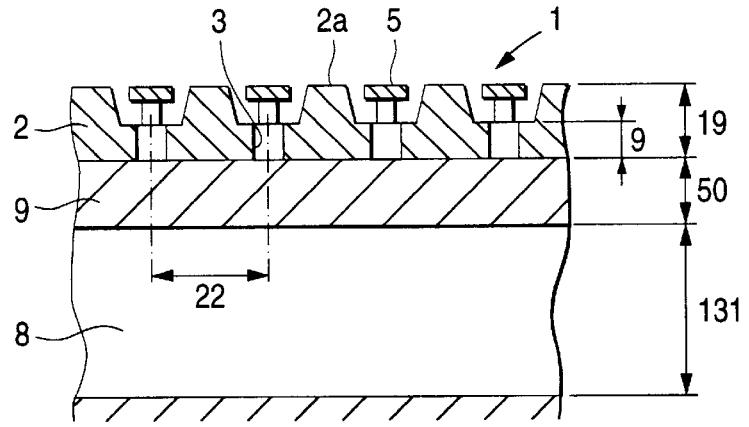
FIGS. 12(*a*), 12(*b*), 12(*c*) and 12(*d*) are schematic sectional views respectively showing sound absorbing structures subjected to measurement of the sound absorbing property.
Figure 12:
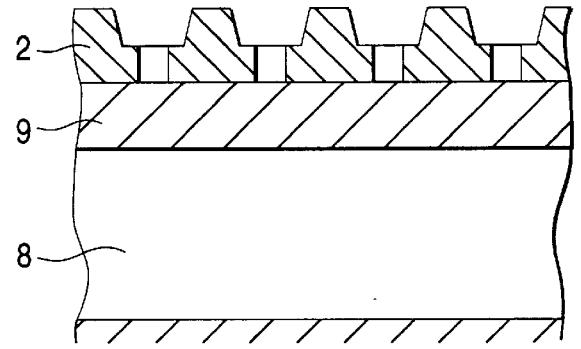
Figure 12:
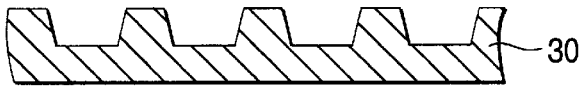
Figure 12:
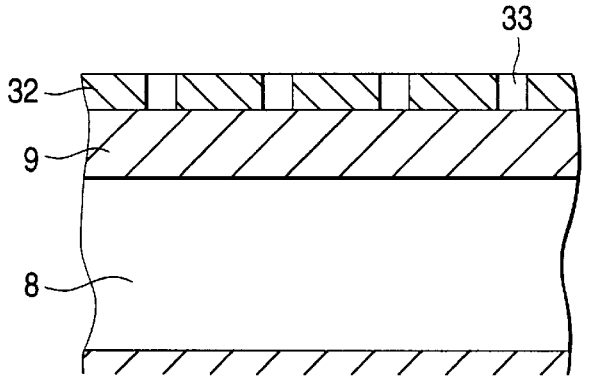

As shown in FIG. 12(*a*), a sound absorbing structure (Structure A) was produced so that a sound absorbing material 9 and a sound absorbing board 1 were disposed in the front of an air chamber 8. The sound absorbing board 1 used herein was constituted by a sound absorbing board body 2 with ribs 2*a*, and concealing materials 5. The size of each portion was as shown in the drawing (unit: mm). The material for the sound absorbing board body 2 was an asbestos board (density: 37 kg/m$^3$). The material for the concealing materials 5 was wood. The hole diameter of the through-holes 3 was 7 mm. The hole pitch in the direction along the ribs 2*a* was 22 mm. Further, the sound absorbing material 9 was formed from glass wool (density: 32 kg/M$^3$).

[EXAMPLE 2]

As shown in FIG. 12(*b*), a sound absorbing board body 2 which was the same as that in Example 1 was singly used as the sound absorbing board to thereby produce a sound absorbing structure (Structure B) which was the same as that in Example 1. The size of each portion and the material for each portion were the same as those in Example 1.

[Comparative Example 1]

As shown in FIG. 12(*c*), a sound absorbing structure (Structure C) was produced from only a sound absorbing board 30 with no through-hole. The size of the sound absorbing board 30 and the material therefor were the same as those of the sound absorbing board body 2 in Example 1, except that the board 30 had no through-hole.

[EXAMPLE 3]

The same structure (that is, Structure A shown in FIG. 12(*a*)) and the same size as those in Example 1 were used but wood was selected to be the materials for the sound absorbing board body 2 and the concealing materials 5.

[EXAMPLE 4]

The same structure (that is, Structure B shown in FIG. 12(*b*)) and the same size as those in Example 2 were used but wood was selected to be the material for the sound absorbing board body 2.

[Comparative Example 2]

The same structure (that is, Structure C shown in FIG. 12(*c*)) and the same size as those in Comparative Example 1 were used but wood was selected to be the material.

[Comparative Example 3]

As shown in FIG. 12(*d*), there was produced a sound absorbing structure (Structure D) which was the same as that in Example 1, except that a sound absorbing board 32 obtained by forming a large number of through-holes 33 in a flat board was used. Wood was selected to be the material for the sound absorbing board 32, and the thickness thereof was selected to be 9 mm. The hole diameter of the through-holes 33 was selected to be 7 mm. The pitch of the through-holes 33 was selected to be 22 mm both in a lateral direction and in a direction perpendicular thereto.

Figure 13:
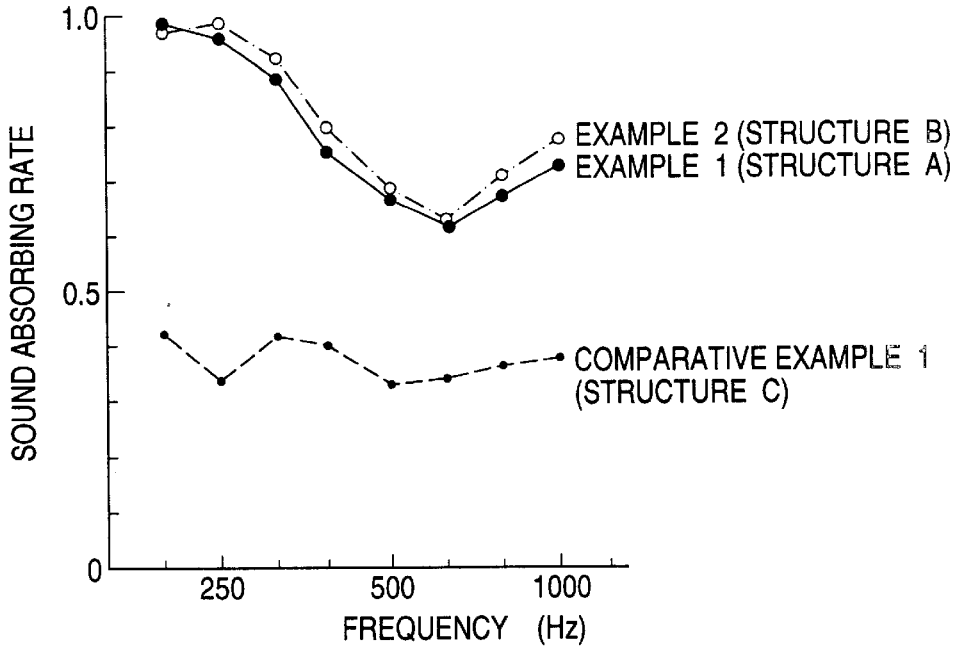
FIG. 13 is a graph showing the results of measurement of the sound absorbing property in the sound absorbing structures in which a sound absorbing board made from asbestos is used.
Figure 14:
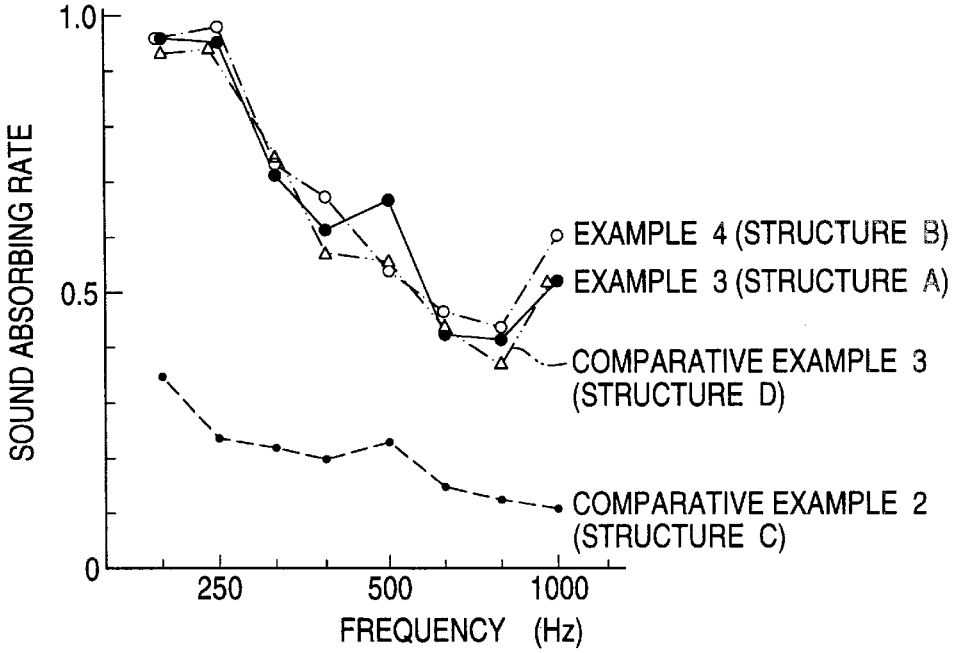
FIG. 14 is a graph showing the results of measurement of the sound absorbing property in the sound absorbing structures in which a sound absorbing board made from wood is used.

Upon the above Examples 1 to 4 and Comparative Examples 1 to 3, the vertical incidence sound absorbing rate was measured. The results of the measurement are shown in Tables 1 and 2. FIGS. 13 and 14 show the graphs illustrated from the results.

TABLE 1

| Frequency (Hz) | 200 | 250 | 315 | 400 | 500 | 630 | 800 | 1000 |
|---|---|---|---|---|---|---|---|---|
| Example 1 | 98.2 | 96.5 | 88.3 | 75.0 | 65.9 | 61.5 | 66.8 | 72.1 |
| Example 2 | 97.4 | 98.7 | 92.2 | 79.4 | 67.7 | 62.0 | 70.8 | 77.3 |
| Com. Ex. 1 | 42.6 | 34.0 | 42.2 | 40.4 | 33.7 | 34.8 | 37.0 | 38.3 |

TABLE 2

| Frequency (Hz) | 200 | 250 | 315 | 400 | 500 | 630 | 800 | 1000 |
|---|---|---|---|---|---|---|---|---|
| Example 3 | 95.8 | 95.0 | 70.4 | 60.3 | 65.5 | 42.6 | 42.0 | 51.5 |
| Example 4 | 95.3 | 98.0 | 77.3 | 65.9 | 54.0 | 46.5 | 44.0 | 58.9 |
| Com. Ex. 2 | 35.0 | 24.0 | 22.3 | 20.0 | 23.5 | 14.5 | 11.9 | 10.0 |
| Com. Ex. 3 | 93.5 | 94.8 | 73.9 | 57.2 | 55.5 | 44.9 | 38.3 | 51.3 |

It is apparent from Tables 1 and 2 and FIGS. 13 and 14 that the sound absorbing rate of the sound absorbing boards (Comparative Examples 1 and 2) without any through-hole is low whereas the sound absorbing rate of the sound absorbing boards each having a porous structure obtained by forming through-holes in a sound absorbing board is improved greatly, particularly, the sound absorbing property in a low frequency band is improved.

In this occasion, if the same material is used for the sound absorbing board, the sound absorbing property in the case (Examples 2 and 4) where ribs are provided on the sound absorbing board, the sound absorbing property in the case (Examples 1 and 3) where ribs and concealing materials are provided and the sound absorbing property in the case (Comparative Example 3) where a flat porous sound absorbing board 32 is used are nearly equal to each other. This fact shows that the sound absorbing property is not deteriorated regardless of the provision of ribs and regardless of the provision of concealing materials. Accordingly, the present invention can improve the external appearance while ribs and concealing materials are provided without any deterioration in sound absorbing property.

Further, it has been found that the sound absorbing property in the case (Examples 1 and 2) where a material having a sound absorbing effect in itself is used for the sound absorbing board is better than that in the case (Examples 3 and 4) where wood having a small sound absorbing effect is used.

Figure 15:
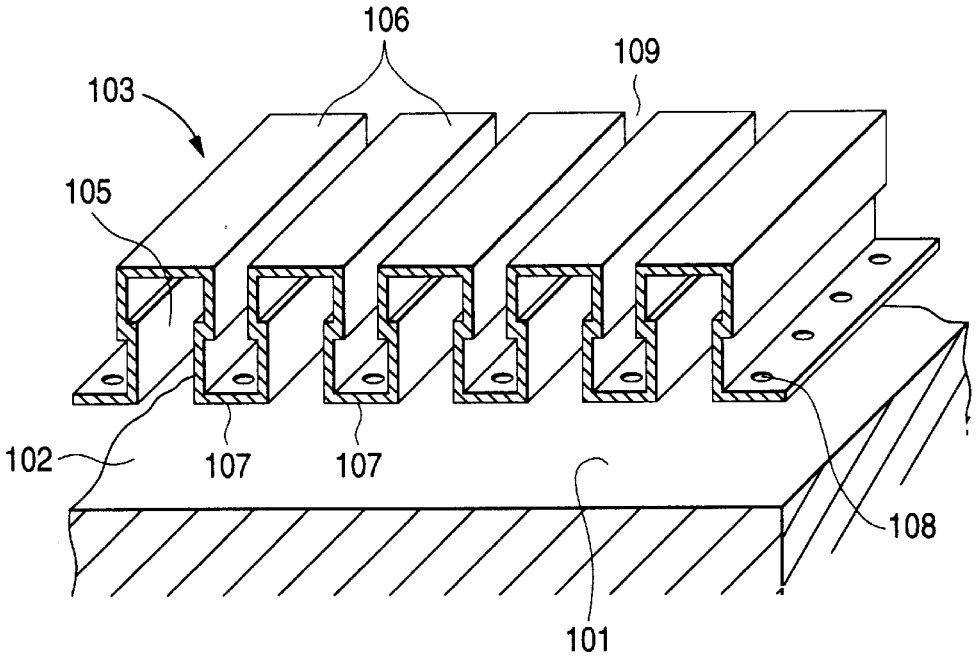
FIG. 15 is a schematic perspective view of a sound absorbing structure configured by using a sound absorbing body according to an embodiment of the present invention.
Figure 16:
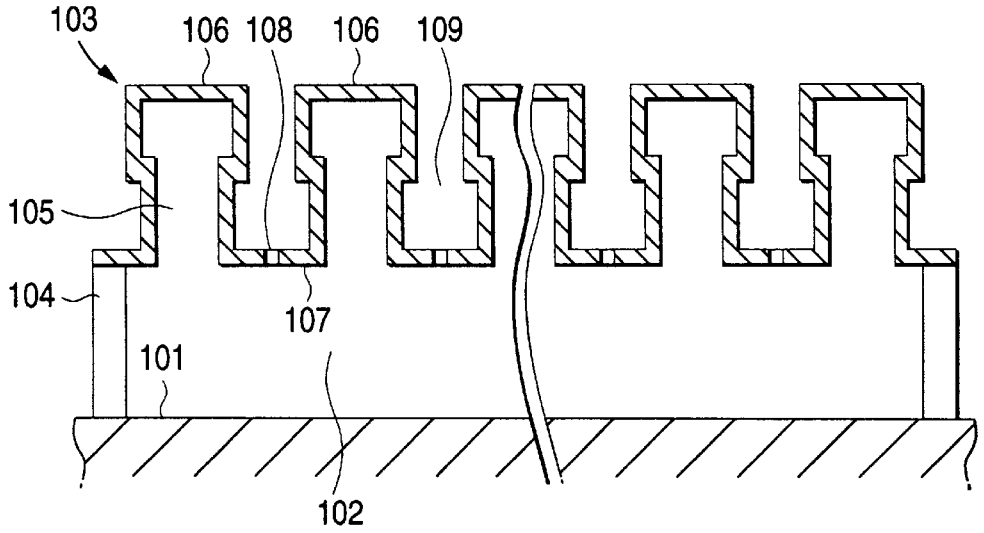
FIG. 16 is a schematic sectional view of the sound absorbing structure.

FIG. 15 is a schematic perspective view of a sound absorbing structure configured by using a sound absorbing body according to an embodiment of the present invention, and FIG. 16 is a schematic sectional view of the sound absorbing structure of FIG. 15.

In the drawings, the reference numeral 101 designates a wall surface; 102, an air chamber; and 103, a sound absorbing body which is attached to the wall surface 101 through spacers 104 so as to be located in the front of the air chamber 102. The wall surface 101, the air chamber 102 and the sound absorbing body 103 constitute a sound absorbing structure. The sound absorbing body 103 is formed from a board material of metal, plastics, wood, or the like, and has: a plurality of ribs 106 provided so as to project to a side opposite to the air chamber 102 and form resonant spaces 105 communicated with the air chamber 102; basal portions 107 formed between the ribs 106; and a plurality of through-holes 108 formed in the basal portions 107 so as to be communicated with the air chamber 102.

In this sound absorbing structure, a sound wave from the outside collides with the sound absorbing body 103 as a surface and enters into the air chamber 102 in the back thereof and into the resonant spaces 105 in the ribs 106 through the through-holes 108, so that the sound wave is absorbed by the resonant effect of the air chamber 102 and the resonant spaces 105. In this occasion, this sound absorbing structure has characteristic in which the sound absorbing effect is particularly high in a low frequency band, as is obvious from results of sound absorbing experiments upon Examples (1) through (8) which will be described later. Further, the sound absorbing effect in this sound absorbing structure in which resonant spaces 105 are provided in the ribs 106 is higher than that in the conventional sound absorbing structure in which a porous board is merely disposed in the front of the air chamber. Accordingly, this sound absorbing structure also has characteristic in which the thickness of the sound absorbing structure can be reduced remarkably.

The thickness of the air chamber 102 formed in the back of the sound absorbing body 103 is determined taking into account the sound-absorption frequency characteristic. For example, the thickness is preferably in a range of from about 20 to about 100 mm.

The width and height of the ribs 106 formed on the sound absorbing body 103, and the volume of the resonant spaces 105 may be determined taking into account the sound-absorption frequency characteristic of a combination of the air chamber 102 and the through-holes 108. For example, the width of the widest portion of the ribs 106 is preferably in a range of from about 40 to about 100 mm, and the height is preferably in a range of from about 50 to about 100 mm. The width of the plurality of ribs 106 provided on the sound absorbing body 103 may be selected to be constant or different. For example, two kinds of ribs 106 different in width may be disposed alternately. Because the width and height of the ribs 106 has influence on the sound-absorption frequency, an effect of high sound absorption in different frequency bands is obtained by using ribs different in width and height.

The through-holes 108 are provided to make entrance of sound into the air chamber 102 easy. The numerical aperture, hole diameter, pitch, etc. thereof may be determined taking into account the sound-absorption frequency characteristic of a combination of the air chamber 102 and the resonant spaces 105. Generally, the numerical aperture is preferably in a range of from about 0.2 to about 10%. Further, the hole diameter is preferably in a range of from about 3 to about 15 mm. Incidentally, the hole pitch may be determined correspondingly to the aforementioned numerical aperture and hole diameter ranges.

The sound absorbing body 103 is disposed as a front surface of the sound absorbing structure, so that the rib 106 side surface is the surface of the sound absorbing structure. That is, the front surface of the sound absorbing structure is in a state in which the plurality of ribs 106 are disposed, so that the through-holes 108 formed in the basal portions 107 are little visible. Accordingly, there is no flicker caused by the through-holes 108 though the sound absorbing structure has such a large number of through-holes 108, so that a stripe-like good external appearance is obtained by arrangement of the ribs 106. Accordingly, there is no unpleasant feeling given to a person seeing the sound absorbing structure, so that a good impression can be given.

Further, because the plurality of ribs 106 have a reinforcing effect, the strength of this sound absorbing structure is higher than that of a simply flat-plate-like porous board. Accordingly, the intervals between support members such as spacers 104 for attaching the sound absorbing body 103 to the wall 101 can be widened, so that the structure of the sound absorbing body 103 can be simplified. Furthermore, because the through-holes 108 are located in the deep positions of the grooves 109, stain or dust can be prevented from being deposited into the through-holes 108, so that the through-holes 108 can be prevented from being choked for a long term.

Figure 17:
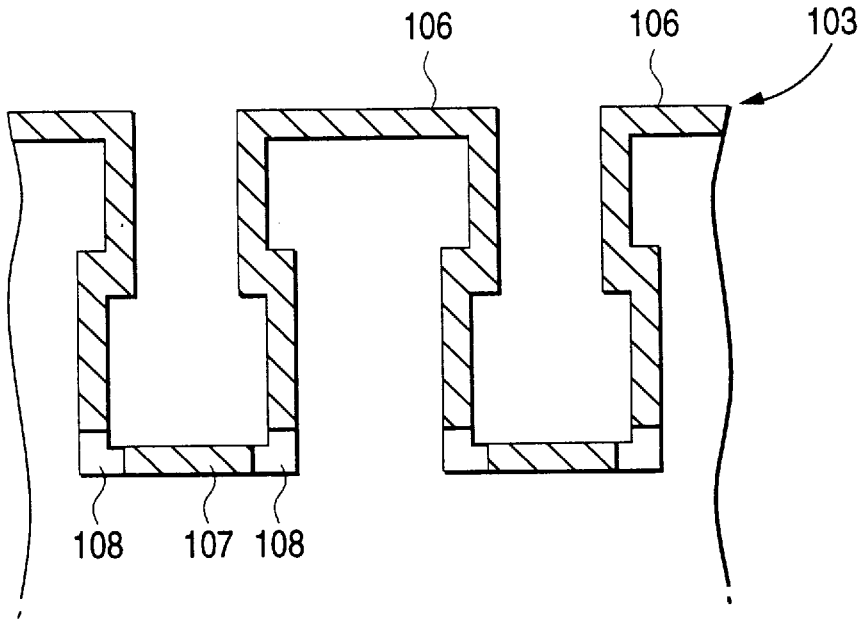
FIGS. 17(*a*) and 17(*b*) are schematic sectional views showing embodiments in which through-holes are provided in positions different from those in the aforementioned embodiment.
Figure 17:
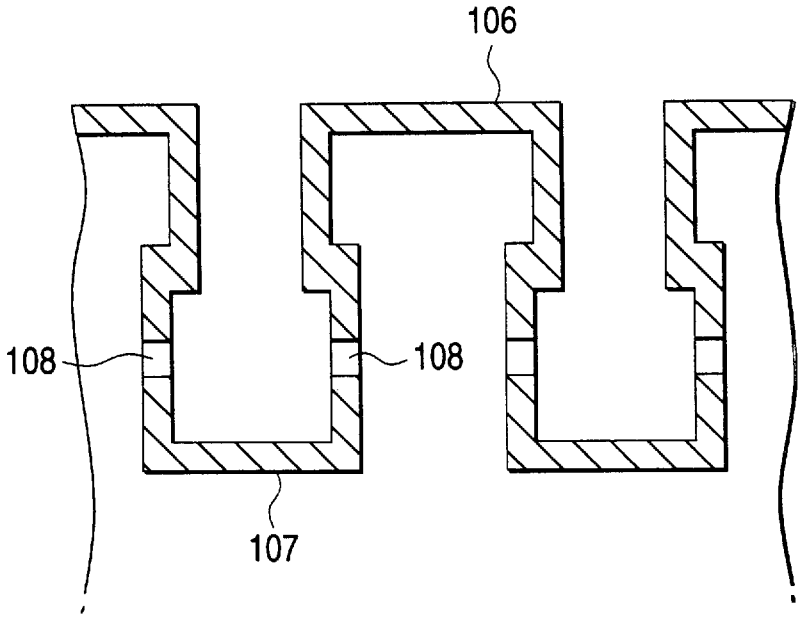

Although the aforementioned embodiment has shown the case where through-holes 108 are formed in the center of the basal portions 107 between the ribs 106, the positions in which the through-holes 108 are formed are not limited thereto and various changes may be made suitably. That is, the through-holes 108 may be disposed in any other positions if the through-holes 108 can be communicated with the inside air chamber 102 or with the resonant spaces 105 and are little visible from the outside. For example, the through-holes 108 may be formed in corner portions of the basal portions 107 as shown in FIG. 17(*a*) or may be formed in side surfaces of the ribs 106 adjacent to the basal portions 107 as shown in FIG. 17(*b*).

As described above, the ribs 106 are provided in order to form resonant spaces 105 to improve the sound absorbing property and make the through-holes 108 invisible. The sectional shape of the ribs 106 can be changed variously and may be suitably designed taking into account design.

In the embodiment of FIG. 15, the ribs 106 are shaped rectangularly so as to be widened toward the front end side. Accordingly, the grooves 109 between the ribs 106 are narrowed toward the front end side, so that there arises an advantage that the effect of concealing the through-holes 108 in the basal portions 107 is high.

Figure 18:
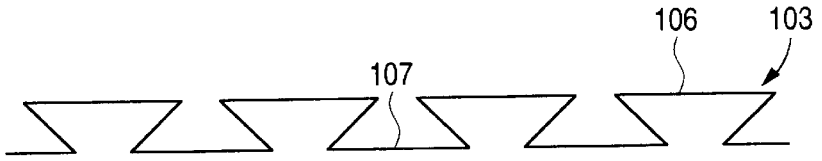
FIGS. 18(*a*) to 18(*g*) are schematic sectional views showing embodiments of the sound absorbing body having a different section.
Figure 18:
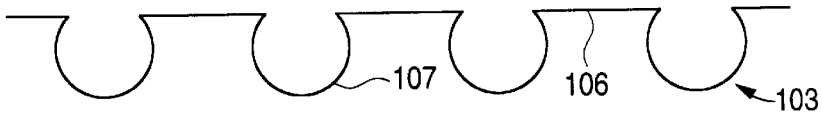
Figure 18:
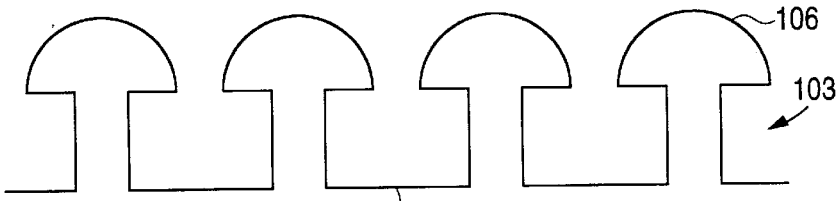
Figure 18:
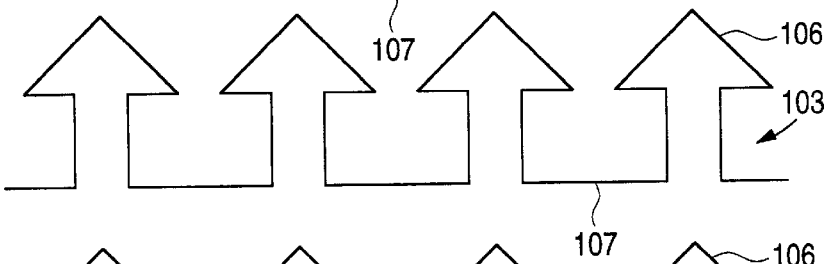
Figure 18:
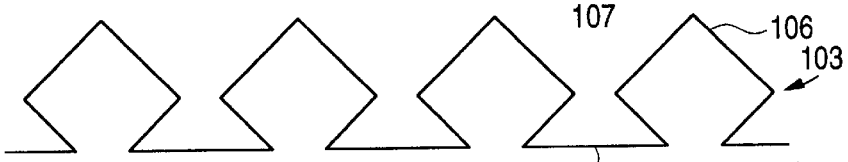
Figure 18:
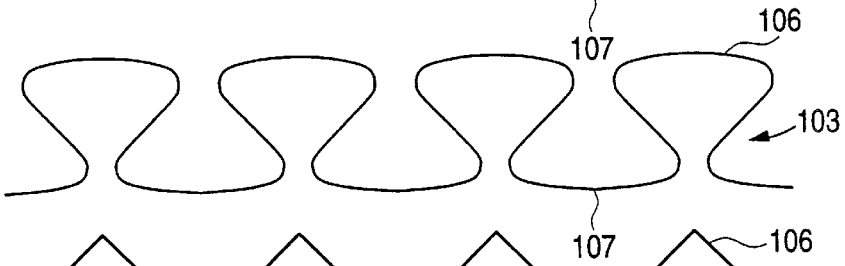
Figure 18:
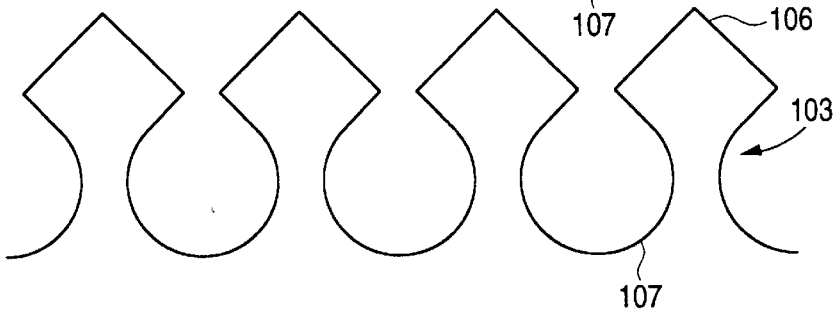

Examples shown in FIGS. 18(*a*) to 18(*g*) can be exemplified as other shapes.

In these drawings, the air chamber is located in the lower side, so that the outer surface (the front surface of the sound absorbing structure) is located in the upper side. In each of sound absorbing bodies 103, each of the ribs 106 has a portion with its sectional shape widened toward the front end side. Accordingly, the effect of concealing the through-holes (not shown in FIG. 18) formed in the basal portions 107 or rib 106 side surfaces is high, so that not only the external appearance is made good but also stain or dust is prevented from being deposited into the through-holes.

Figure 19:
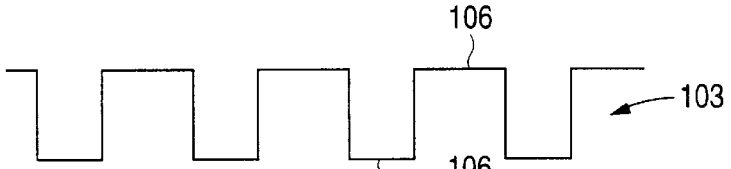
FIGS. 19(*a*) and 19(*b*) are schematic sectional views showing embodiments of the sound absorbing body having a section different from that in the aforementioned embodiment.
Figure 19:
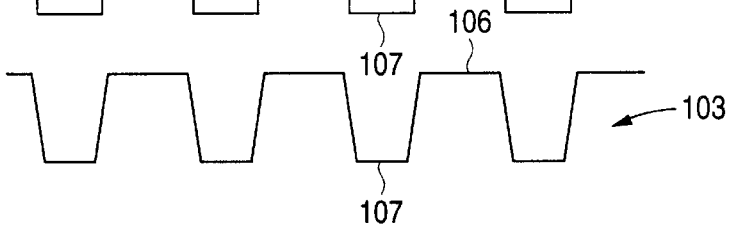

Alternatively, ribs 106 of a simple sectional shape as shown in FIGS. 19(*a*) and 19(*b*) may be used. In this case, there arises an advantage that the sound absorbing body 103 is produced easily.

The sound absorbing body 103 in the embodiment shown in FIG. 16 is simply constituted by a plurality of ribs 106 and basal portions 107 between the ribs 106, and the sound absorbing body 103 is attached to the wall surface 101 through the spacers 104. The sound absorbing body 103 according to the present invention is, however, not limited to the aforementioned configuration, and the spacer 104 as mount legs for attachment to the wall surface may be integrated with the sound absorbing body 103.

Figure 20:
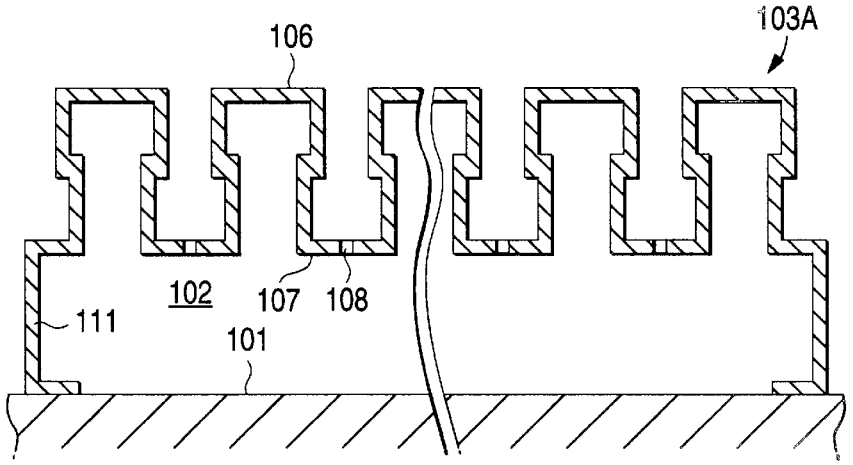
FIG. 20 is a schematic sectional view showing a sound absorbing body according to another embodiment of the present invention.

FIG. 20 shows a sound absorbing body 103A in this case. The sound absorbing body 103A has a plurality of ribs 106, basal portions 107 between the ribs 106, and legs 111 at opposite ends to thus form a one-board structure. The sound absorbing body 103A is attached to the wall surface 101 with use of the legs 111 so that an air chamber 102 having a predetermined thickness can be formed between the sound absorbing body 103A and the wall surface 101.

Figure 21:
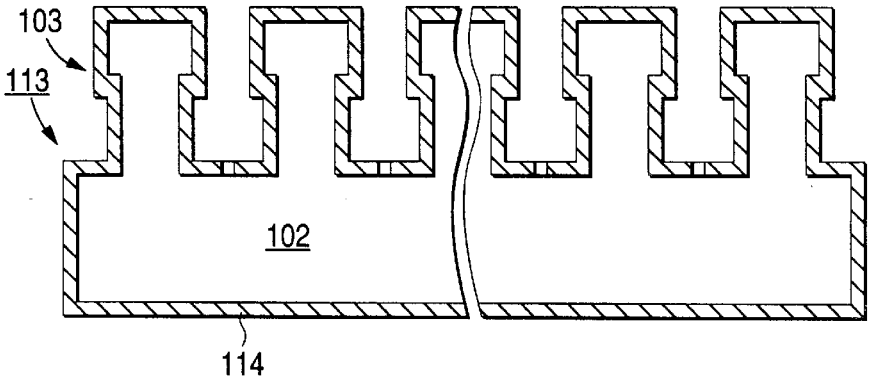
FIG. 21 is a schematic sectional view showing a sound absorbing unit according to a further embodiment of the present invention.

FIG. 21 shows a sound absorbing unit 113 obtained by using the sound absorbing body 103 and the air chamber 102 as one unit.

That is, the sound absorbing unit 113 is formed as a united structure from a sound absorbing body 103 disposed in the front and a back board 114 disposed in the back with separation to form an air chamber 102. The sound absorbing unit 113 has an advantage that a sound absorbing wall having a constant sound absorbing property can be formed easily only by arranging sound absorbing units 113 side by side. Any one of the aforementioned materials can be used suitably as the sound absorbing body 103.

Although the aforementioned embodiment has shown the case where the air chamber 102 in the back of the sound absorbing body 103 forms one large space, the air chamber 102 may be partitioned into a plurality of small chambers.

Figure 22:
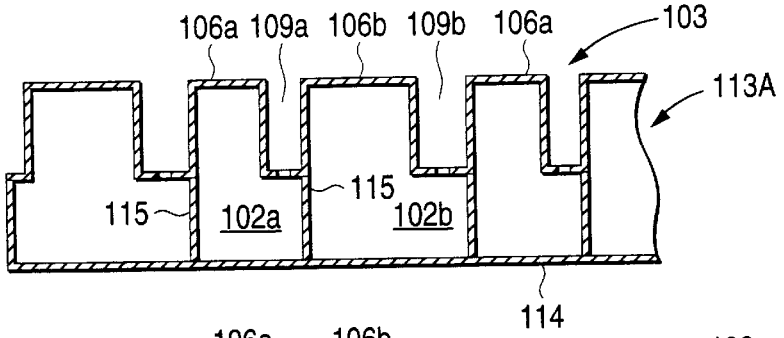
FIGS. 22(*a*) and 22(*b*) are schematic sectional views of the sound absorbing unit according to further embodiments of the present invention.
Figure 22:
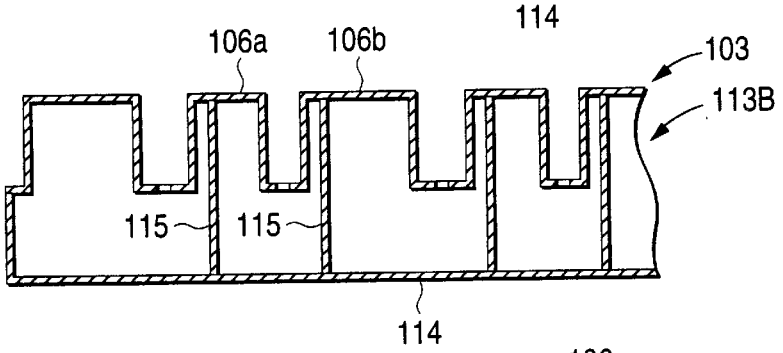

FIG. 22 shows embodiments in which the air chamber 102 is partitioned into small chambers.

In the sound absorbing unit 113A shown in FIG. 22(*a*), two kinds of ribs 106*a* and 106*b* different in width are alternately disposed on the sound absorbing body 103 disposed in the front so that grooves 109*a* and 109*b* different in width are formed between the ribs 106*a* and 106*b*. Further, partition walls 115 are provided on the rear surfaces of one end portions of the basal portions 107, that is, on the extension lines of one-side surfaces of the ribs 106*a* and 106*b*, so that the air chamber is partitioned into a plurality of small chambers 102*a* and 102*b*.

In such configuration, the air chamber is partitioned into air chambers 102*a* and 102*b* different in volume, so that one air chamber 102*a* absorbs a sound of a certain frequency whereas the other air chamber 102*b* absorbs a sound of a different frequency. Accordingly, there arises an advantage that the sound-absorption frequency band is widened.

Further, in the sound absorbing unit 113B shown in FIG. 22(*b*), partition walls 115 are provided in the ribs 106*a* and 106*b*. Also in this case, the same effect as shown in FIG. 22(*a*) is obtained.

Although the embodiments shown in FIGS. 22(*a*) and 22(*b*) has been described upon the case where the air chamber is partitioned into air chambers different in volume, the air chamber may be partitioned into equal volume air chambers. When the air chamber is partitioned into small-volume chambers, the sound absorbing property is improved with respect to a sound in a narrow frequency band corresponding to the volume of the air chambers obtained by partition. Accordingly, partition is effective in the case where the frequency of noise produced is limited to a narrow frequency range.

Although the sound absorbing units 113A and 113B of FIGS. 22(*a*) and 22(*b*), have been described upon the case where the ribs 106*a* and 106*b* of the sound absorbing body 103 in the front are shaped simply rectangularly, the shape of the sound absorbing body 103 in the front is not limited thereto and various shapes may be used as shown in FIGS. 15 to 19.

That is, partition walls 115 shown in FIG. 22 may be provided in the back of the sound absorbing body 103 shown in FIGS. 15 to 19 so that the air chamber is partitioned into a plurality of air chambers. Further, it is unnecessary that the back board 114 is always provided when such partition walls 115 are provided. For example, when the sound absorbing body 103 is attached to the wall surface 101 (see FIG. 15), the partition walls 115 may strike on the wall surface 101 so that the air chamber between the sound absorbing body 103 and the wall surface 101 can be partitioned into a plurality of air chambers.

Although the above embodiment has shown the case where the sound absorbing body 103 is made from a board material and constituted by ribs 106 and basal portions 107, a combination of sound absorbing materials and the sound absorbing body 103 may be used.

Figure 23:
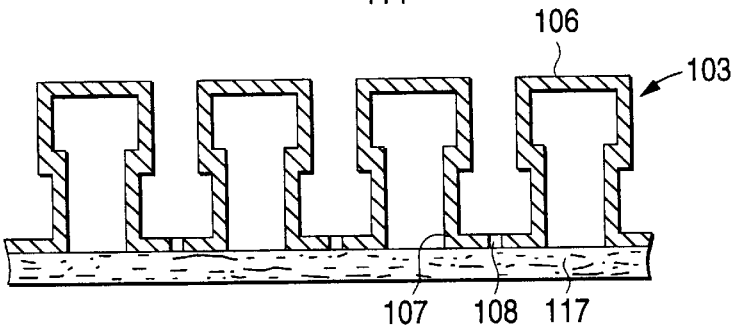
FIGS. 23(*a*), 23(*b*) and 23(*c*) are schematic sectional views of the sound absorbing body according to further embodiments of the present invention.
Figure 23:
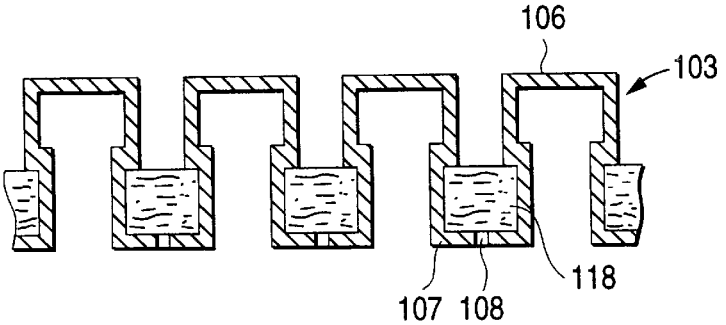
Figure 23:
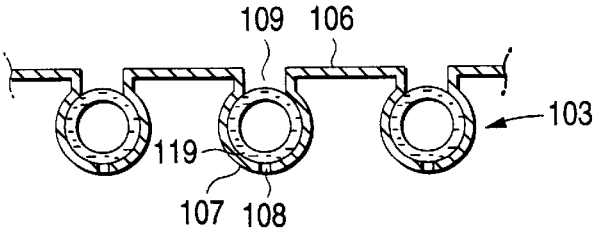
Figure 24A:
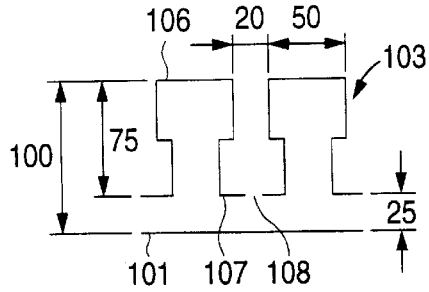
FIGS. 24(*a*) to 24(*h*) are schematic sectional views showing sectional structures in Examples 5 to 12.
Figure 24B:
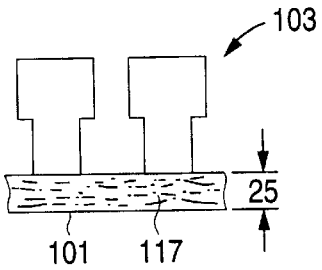
Figure 24C:
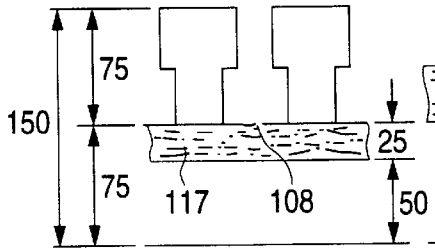
Figure 24D:
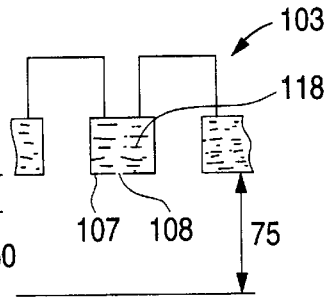
Figure 24E:
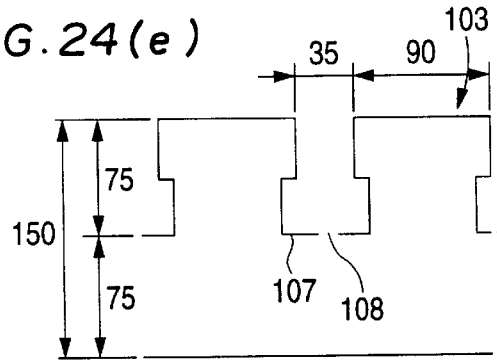
Figure 24F:
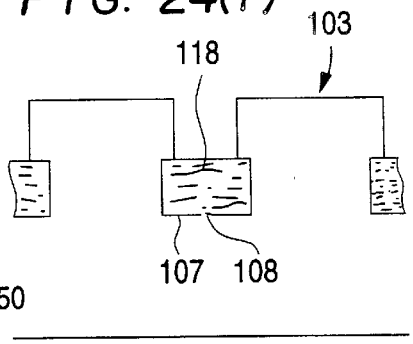
Figure 24G:
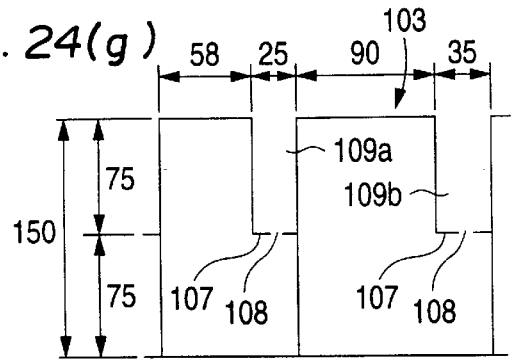
Figure 24H:
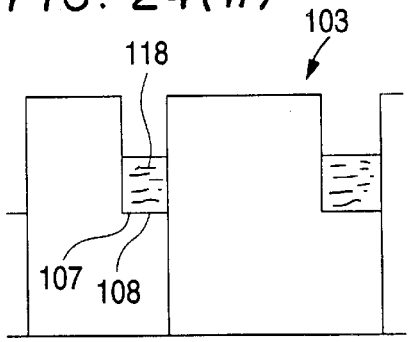

FIGS. 23(*a*), 23(*b*), and 23(*c*) show examples in which the sound absorbing body 103 is combined with the sound absorbing material.

FIG. 23(*a*) shows the case where a board-like sound absorbing material 117 is disposed on the air chamber side surface, that is, back surface of the sound absorbing body 103, FIG. 23(*b*) shows the case where sound absorbing materials 118 are disposed on the outer surfaces of the basal portions 107 between the ribs 106 of the sound absorbing body 103, and FIG. 23(*c*) shows the case where cylindrical sound absorbing materials 119 are disposed in the grooves 109 formed between the ribs 106. Each of the sound absorbing materials 117, 118 and 119 used herein is a material having a sound absorbing effect in itself. Generally, porous materials such as glass wool, rock wool, fiber mat material, etc., film materials such as sail cloth, etc., and so on, are used. When such sound absorbing materials are used in combination, the sound-absorption frequency band can be widened.

Results of measurement of the sound absorbing property of various sound absorbing bodies according to embodiments of the present invention will be described below.

[EXAMPLES 5 to 12]

The sound absorbing structures used are as shown in the diagrams of FIGS. 24(*a*) to 24(*h*) which correspond to examples 5 to 12, respectively. The unit of size shown in the diagrams is mm.

The sound absorbing body 103 of the diagram (6) was produced by adding the sound absorbing material 117 to the sound absorbing body 103 of the diagram (5). The sound absorbing body 103 of the diagram (3) or (4) was produced by changing the thickness of the air chamber in the back of the sound absorbing body 103 of the diagram (5) and adding the sound absorbing materials 117 and 118 to the sound absorbing body 103 of the diagram (5). In the sound absorbing body 103 shown in the diagrams (5) to (8), one row of through-holes 108 with a diameter of 9 mm were disposed in the center of the basal portion 107 at intervals of a pitch of 50 mm. The sound absorbing body 3 of the diagram (10) was produced by adding the sound absorbing materials 118 to the sound absorbing body 103 of the diagram (9). In the sound absorbing body 103 shown in the diagrams (9) and (10), one row of through-holes 108 with a diameter of 10 mm were disposed in the center of the basal portion 107 at intervals of a pitch of 100 mm. The sound absorbing body 103 of the diagram (12) was produced by adding the sound absorbing materials 118 to the sound absorbing body 103 of the diagram (11). In the sound absorbing body 103 shown in the diagrams (11) and (12), one row of through-holes 108 with a diameter of 9 mm were formed in the center of the basal portion 107 in the bottom surface of a narrower groove 109*a* at intervals of a pitch of 50 mm, and one row of through-holes 108 with a diameter of 10 mm were formed in the center of the basal portion 107 in the bottom surface of a wider groove 109*b* at intervals of a pitch of 100 mm. The sound absorbing materials 117 and 118 used were glass wool.

The sound absorbing rate of each sound absorbing structure shown in FIG. 24 was measured to obtain a statistical incidence sound absorbing rate. Results thereof are shown in Table 3. Incidentally, the unit of the statistical incidence sound absorbing rate shown in Table 3 is %.

TABLE 3

| | Frequency (Hz) | | | | | | | | |
|---|---|---|---|---|---|---|---|---|---|
| | 63 | 80 | 100 | 125 | 160 | 200 | 250 | 315 | 400 |
| Ex. | | | | | | | | | |
| 5 | 9 | 13 | 12 | 17 | 28 | 53 | 81 | 82 | 53 |
| 6 | 15 | 24 | 28 | 44 | 63 | 85 | 83 | 84 | 82 |
| 7 | 20 | 28 | 40 | 66 | 82 | 86 | 77 | 60 | 44 |
| 8 | 32 | 43 | 61 | 77 | 86 | 84 | 86 | 80 | 82 |
| 9 | 22 | 39 | 48 | 86 | 84 | 59 | 42 | 34 | 30 |
| 10 | 47 | 74 | 83 | 86 | 81 | 70 | 60 | 53 | 50 |
| 11 | 20 | 54 | 76 | 39 | 85 | 53 | 32 | 60 | 22 |
| 12 | 59 | 80 | 74 | 83 | 77 | 66 | 65 | 65 | 43 |
| Co. Ex. | | | | | | | | | |
| 4 | — | — | — | 35 | 42 | 35 | 37 | 30 | 27 |
| 5 | — | — | — | 68 | 80 | 86 | 82 | 72 | 67 |
| 6 | — | — | — | 62 | 77 | 92 | 94 | 90 | 92 |

[Comparative Examples 4 to 6]

Figure 25A:
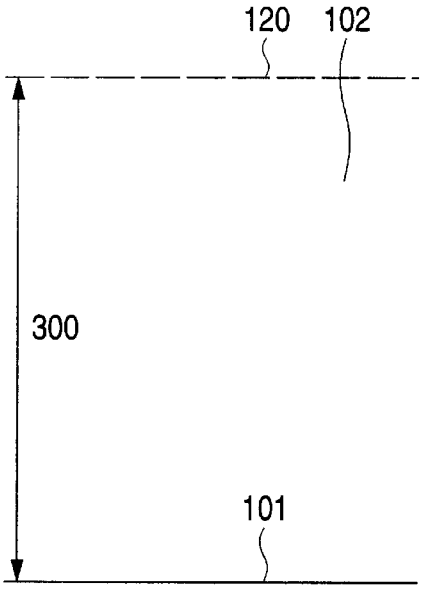
FIGS. 25(*a*) to 25(*c*) are schematic sectional views showing sectional structures in Comparative Examples 4 to 6.
Figure 25B:
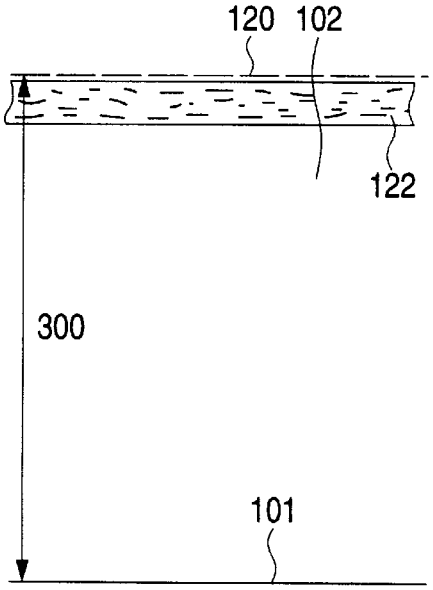
Figure 25C:
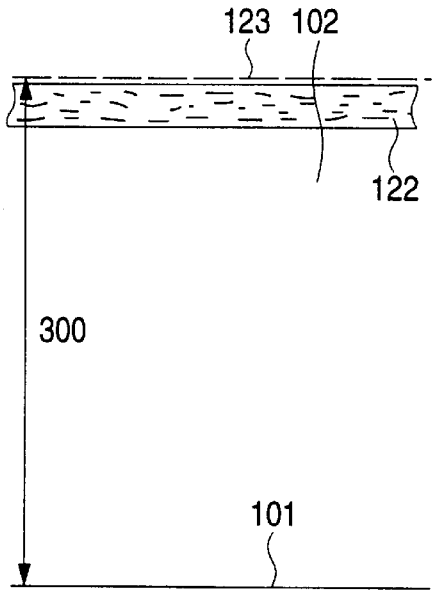

As shown in FIGS. 25(*a*) to 25(*c*), in the case (Comparative Example 4) a porous gypsum board 120 was disposed to form a 300 mm air chamber 102 in front of the wall surface 101, in the case (Comparative Example 5) where a rock wool sound absorbing felt 122 with a thickness of 25 mm was disposed in the back surface of the porous gypsum board 120, and in the case (Comparative Example 6) where a porous calcium silicate board 123 was disposed to form a 300 mm air chamber 102 in front of the wall surface 101 and a rock wool sound absorbing felt 122 with a thickness of 25 mm is disposed in the back of the porous calcium silicate board 123, the results of sound absorption are also shown in Table 3.

Figure 26:
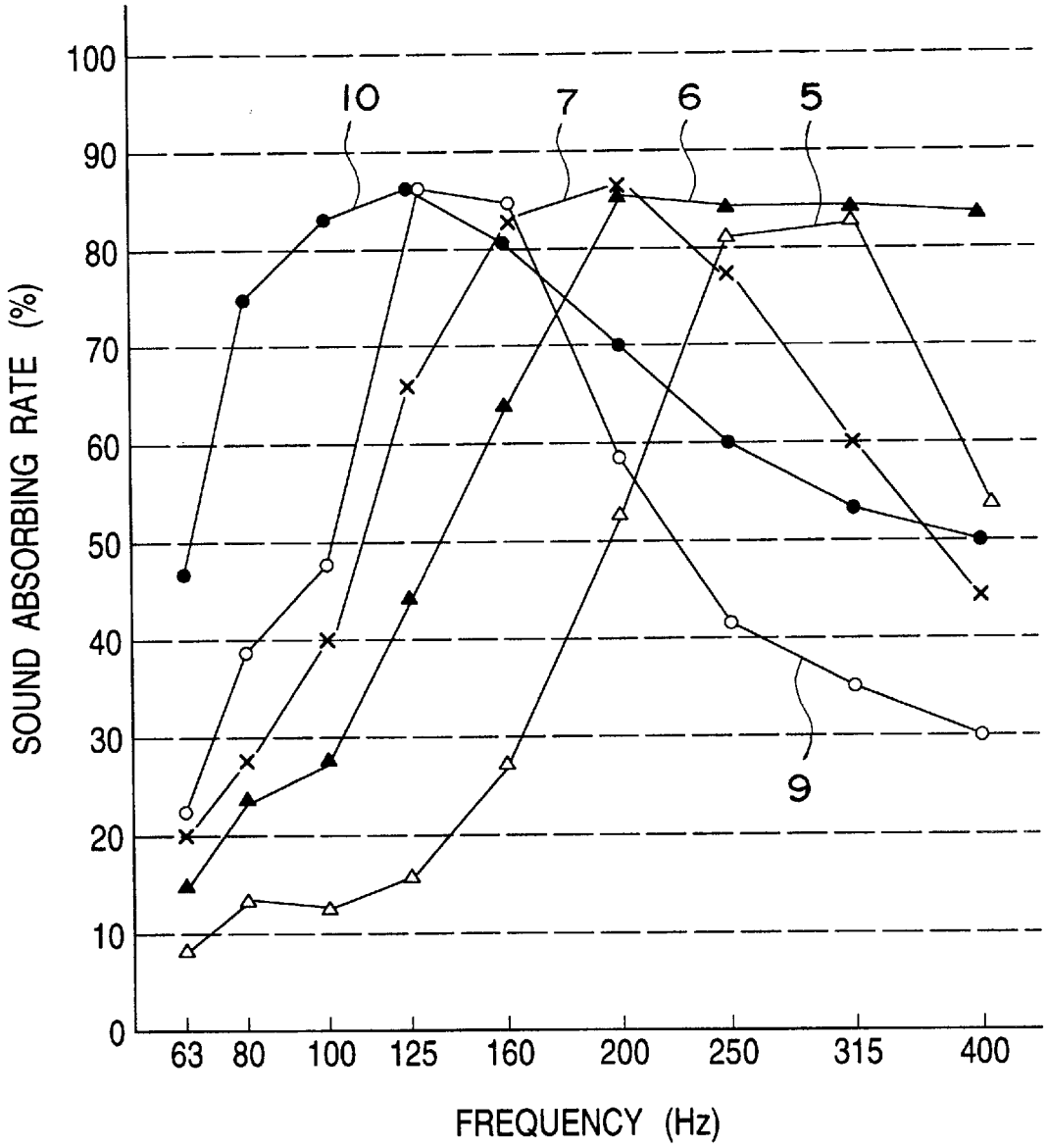
FIG. 26 is a graph showing the sound absorbing property in Examples 5, 6, 7, 9, and 10.
Figure 27:
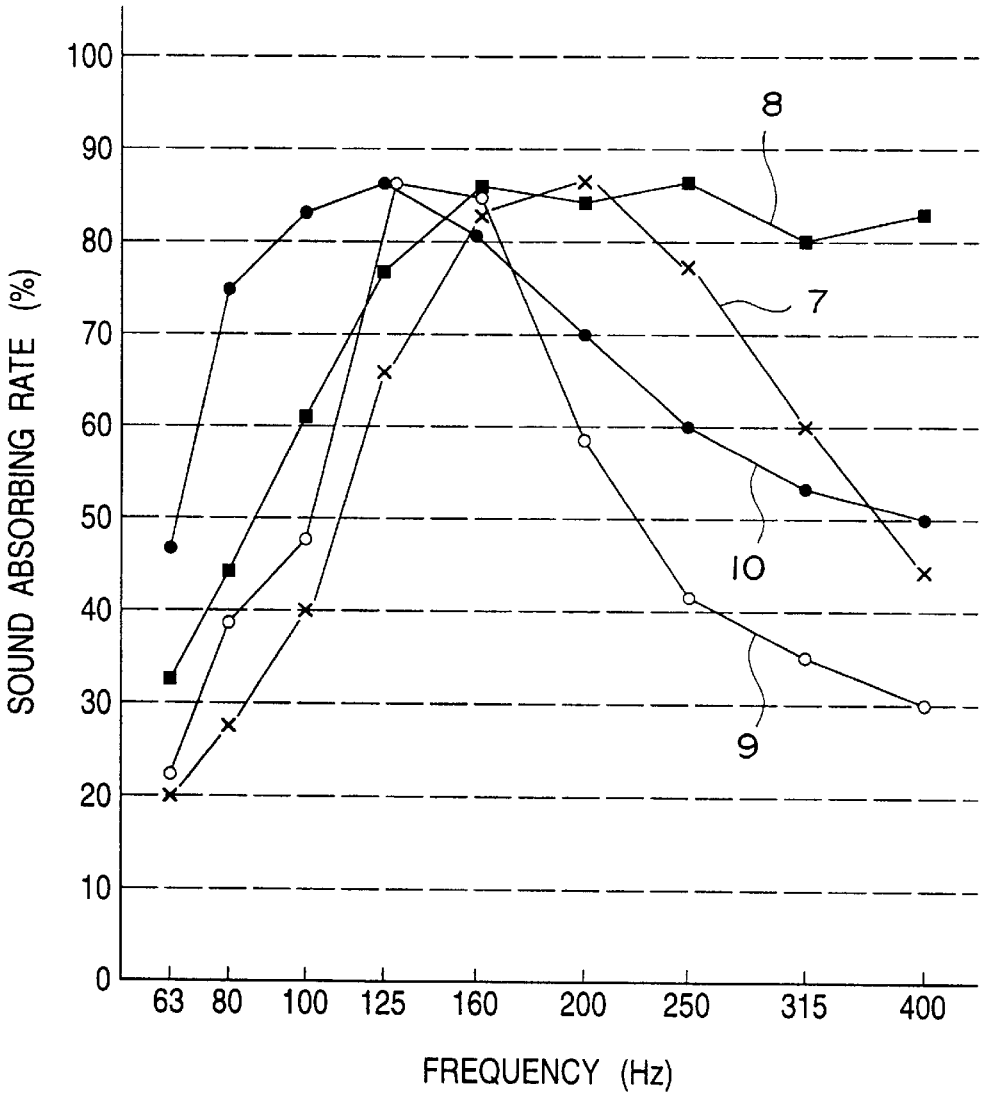
FIG. 27 is a graph showing the sound absorbing property in Examples 7, 8, 9, and 10.
Figure 28:
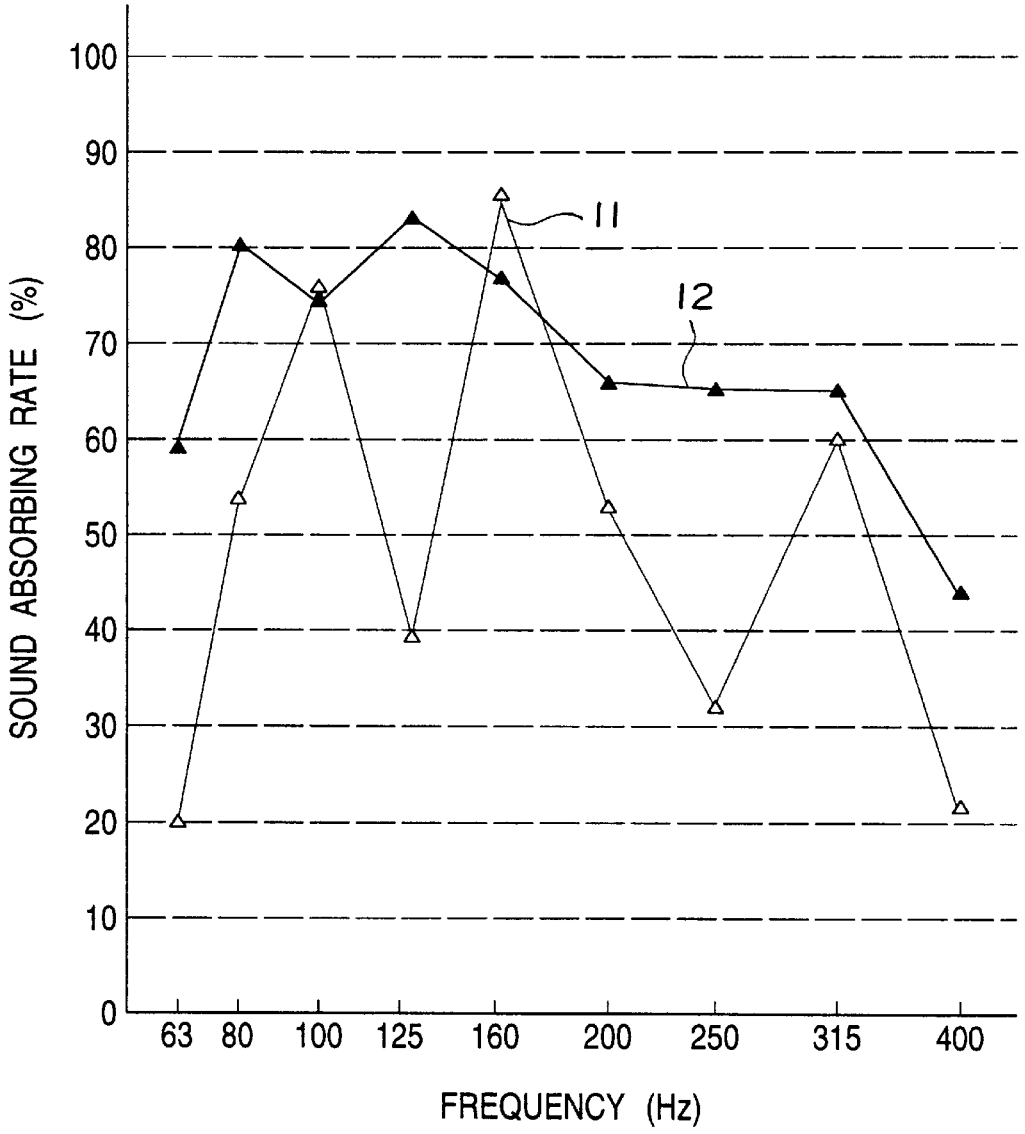
FIG. 28 is a graph showing the sound absorbing property in Examples 11 and 12.

Results of Table 3 are shown as graphs of FIGS. 26 to 28. Reference numerals (5) to (12) in the drawings correspond to examples 5 to 12, respectively.

It is apparent from Table 3 and FIGS. 26 through 28 that in Examples 5 and 9, there is a region exhibiting a high sound absorbing rate in a relatively narrow frequency band and that particularly in Example 9, there is a peak of the sound absorbing rate in a low frequency band of from 125 to 160 Hz. Accordingly, a sound absorbing structure having a high sound absorbing rate in a desired low frequency band can be achieved by designing the width of the ribs 106 and the depth of the air chamber 102 suitably.

Further, in Example 11, there are peaks of high sound absorbing rate in a plurality of frequency bands. Accordingly, the Example 11 is adapted for the purpose of requiring sound absorption in a plurality of frequency bands.

Further, in comparison between the case where the sound absorbing material 117 or 118 is used (Examples 6, 7, 8, 9, 12) and the case where the sound absorbing material is not used, the sound absorbing rate in the wide frequency band is improved, though the peak sound absorbing rate is not so changed. Accordingly, when the frequency band of noise is wide, the sound absorbing material is preferably used.

Further, in comparison between results of Examples 7 and 8, the sound absorbing property in Example 8 is superior. Accordingly, the sound absorbing material 118 is preferably disposed on the outer surface of the sound absorbing body 103 if only the sound absorbing property is taken into account.

On the contrary, the sound absorbing effect in Comparative Example 4 is low as a whole, so that it cannot be said that Comparative Example 4 is effective. In Comparative Examples 5 and 6, the sound absorbing effect is improved considerably but the effect is mainly obtained in a frequency band of not lower than 200 Hz. There is no improvement of the effect in a low frequency band of not higher than 160 Hz.

On the contrary, in Examples 7 to 12 of the present invention, not only a considerable sound absorbing effect is obtained in a low frequency band of not higher than 160 Hz but also a sufficient sound absorbing effect is obtained even in the case where the thickness of the sound absorbing structure as a whole is reduced to 150 mm which is a half the thickness 300 mm in Comparative Examples 4 to 6. It is thought that this effect is obtained by the resonant spaces 105 formed in the ribs 106.

(Effects of the Invention)

As described above, in the sound absorbing body according to the present invention, a plurality of ribs each having a desired cross-sectional shape are formed convexly at predetermined intervals on a front surface of the sound absorbing body for reinforcing the sound absorbing body. Further, through-holes are formed through the sound absorbing body from its front surface to its back surface correspondingly to the respective ribs. Furthermore, concealing materials are provided between the ribs on the front surface of the sound absorbing body for concealing the through-holes. Accordingly, for example, when the sound absorbing body is attached in the front of an air chamber so that the surface on which the ribs are formed is located in the outside, a sound absorbing structure good in sound absorbing property particularly in a low frequency band can be formed, and there can be obtained a good appearance in which no flicker is caused by the through-holes, and the plurality of ribs are arranged. Further, more superior appearances can be provided by suitably modifying the sectional shapes or the like of the ribs so that the design can be changed variously. Further, dust can be prevented from adhering on the inside surface of the through-holes and blockage of the through-holes or the like can be prevented for a long term. In addition, the strength of the sound absorbing board can be increased by the reinforcing effect of the ribs.

According to the sound absorbing body of an embodiment of the present invention, in the sound absorbing body, the ribs are provided integrally with the sound absorbing body, so that the number of assembling steps can be decreased and the strength of the sound absorbing body can be increased.

According to the sound absorbing body of the invention, a plurality of ribs each having a predetermined sectional shape are protruded from at least one of the surfaces of the sound absorbing main body, with predetermined intervals therebetween. Further, a plurality of through-holes are formed correspondingly to the respective ribs so as to pass through the sound absorbing main body from one side thereof to the other side. Accordingly, for example, when the sound absorbing body is attached in the front of an air chamber so that the surface on which the ribs are formed is located in the outside, a sound absorbing structure good in sound absorbing property particularly in a low frequency band can be formed, and there can be obtained a good appearance in which no flicker is caused by the through-holes, and the plurality of ribs are arranged. Further, more superior appearances can be provided by suitably modifying the sectional shapes or the like of the ribs so that the design can be changed variously. Further, since the ribs are provided integrally with the sound absorbing main body, the number of assembling steps can be reduced and the strength of the sound absorbing body can be increased.

According to the sound absorbing board of another embodiment of the present invention, a plurality of ribs provided on a front surface of the sound absorbing board body for reinforcing the sound absorbing body and a plurality of through-holes formed in the base portions between the ribs on the front surface of the sound absorbing body are provided. Accordingly, when the sound absorbing board body is attached in the front of an air chamber so that the surface on which the ribs are formed is located in the outside, a sound absorbing structure good in sound absorbing property particularly in a low frequency band can be formed. Further, an external appearance in which the large number of ribs are disposed is obtained so that there is no flicker caused by the holes and no unpleasant feeling given to a person even though the large number of holes are formed. Further, various external appearances can be provided by appropriately changing the intervals between the ribs and the width of the ribs, so that the design can be changed variously. Further, the plurality of ribs also have a reinforcing function, so that the strength of the sound absorbing board can be improved. Further, since the concealing materials for concealing the through-holes are provided on the front surface of the sound absorbing board body, the through-holes are not seen from the outside so that no further visual flickering or the like is caused by a number of through-holes and a good appearance can be obtained. Further, dust can be prevented from adhering on the inside surface of the through-holes and blockage of the through-holes or the like can be prevented for a long term. In addition, the strength, of the sound absorbing board can be increased by the reinforcing effect of the ribs.

According to the sound absorbing board according to another aspect of the present invention, a plurality of ribs each having a cross-sectional shape widened toward its top end are provided on a front surface of the sound absorbing board body, and the sound absorbing board body has a porous structure in which a plurality of through-holes are formed through the sound absorbing board body to reach its back surface in portions at root ends of the ribs concealed by the top ends of the ribs. Accordingly, for example, by attaching the sound absorbing board in the front of the air chamber such that the side on which the ribs are formed is made outside, it is possible to constitute a sound absorbing structure which is superior in sound absorbing characteristic especially in the low frequency area. The appearance shows a shape in which numbers of ribs are disposed side-by-side, and a number of through-holes are formed in positions concealed by the ribs. Further, each rib is made to have a cross-sectional shape widened toward its top end like a reversed trapezoid and the diameter of each through-hole is set to be longer than the width of the root end of the rib and shorter than the width of the top end of the rib so that the through-holes open on both sides of each of the ribs. Accordingly, in spite of the fact that each through-hole can be set to have a relatively large aperture diameter, the through-holes, are not so clearly seen from the outside, so that it is possible to obtain a preferable appearance having no visual flickering or the like caused by the numbers of through-holes. In addition, the strength of the sound absorbing board can be increased by the reinforcing effect of the ribs.

According to a sound absorbing body of the invention, a plurality of ribs are provided to project to a side opposite to the air chamber so as to form resonant spaces communicated with the air chamber; and a plurality of through-holes are formed at least in the ribs or in the basal portions formed between the ribs so as to communicate with the air chamber. Accordingly, there can be obtained a sound absorbing structure good in sound absorbing property particularly in a low frequency band by a combination of the sound absorbing body and the air chamber. Furthermore, because spaces in the ribs serve as resonant spaces in this occasion, not only the sound absorbing property is improved but also the sound absorbing structure can be made thin compared with the case where the conventional porous board is used. For example, the thickness of the sound absorbing structure can be reduced to 150 mm, which is a half the thickness 300 mm in the case where the porous board is used, while keeping the sound absorbing effect.

Furthermore, with respect to the external appearance, the plurality of ribs are disposed in the front, so that the through-holes are inconspicuous. Accordingly, there is no flicker caused by the through-holes, so that no unpleasant feeling is given. Furthermore, various external appearances can be provided by changing the interval and width of the ribs suitably, so that the design can be changed variously. Further, the strength of the sound absorbing body can be improved by the reinforcing effect of the ribs.

According to a sound absorbing body of the invention, the sound absorbing body comprises a sound absorbing material which is disposed at least on inner or outer surface of the basal portions between the ribs, by which not only the resonant frequency band can be widened but also the sound absorbing property in a wide frequency band can be improved.

According to a sound absorbing body of the invention, the sound absorbing body comprises partition walls which are disposed at least on the rear surfaces of the ribs or on the basal portions between the ribs to partition the spaces in the air chamber located in the back. Accordingly, a plurality of independent small chambers are formed so that resonant frequencies corresponding to the independent small chambers can be provided, or in other words, a sound absorbing structure having a desired sound absorbing property can be designed easily if the volumes of the independent small chambers are designed to be in values corresponding to required resonant frequencies.

According to a sound absorbing body of the invention, each of the ribs has a portion with its sectional shape widened toward the front end. Accordingly, the effect in which the ribs conceal the through-holes is high, so that a good external appearance is obtained. At the same time, there arises an effect that stain or dust is prevented from being deposited into the through-holes, so that the through-holes can be prevented from being choked for a long term.

According to a sound absorbing body of the invention, the volumes of resonant spaces formed by the ribs are classified into two or more kinds. Accordingly, a plurality of resonant frequencies can be provided, so that the sound absorbing property in a wide frequency band can be improved. If a sound absorbing material is used in addition to the sound absorbing body of such a structure, sound absorbing characteristic in the wider frequency range can be improved so that noises of a wide frequency range can be effectively absorbed.

Accordingly to a sound absorbing unit of the invention, the sound absorbing unit comprises the sound absorbing body as mentioned above; and a back board integrally provided with the sound absorbing body and disposed in the back of the sound absorbing body at a distance so as to define an air chamber therebetween. Accordingly, a wall surface having a required sound absorbing property can be formed simply by arranging such sound absorbing units, so that a sound absorbing structure can be produced easily on site. In the sound absorbing body according to embodiments of the present invention, the configuration is such that the ribs and the concealing materials are made even in their upper surface or the upper surface of the ribs project beyond the upper surface or the upper surface of the ribs project beyond the upper surface of the concealing materials because the height of the upper surface of the concealing materials is made to be not higher than the upper surface of the ribs. Accordingly, it is possible top prevent the concealing materials from being injured by being caught by something.

What is claimed is:

1. A sound absorbing body comprising:

a sound absorbing main body formed substantially in the shape of a plate;

a plurality of projecting ribs at predetermined intervals on a front surface side of said sound absorbing main body for reinforcing said sound absorbing main body, each of said ribs having a desired cross-sectional shape;

through-holes formed through said sound absorbing main body from a front surface thereof to to a back surface thereof at respective locations positioned between said ribs; and concealing materials disposed between said ribs on the front surface side of said sound absorbing main body and concealing said through-holes;

wherein slits are formed between the concealing materials and said ribs which communicate with said through-holes.

2. A sound absorbing body as claimed in claim 1, wherein the ribs are provided integrally with the sound absorbing main body.

3. A sound absorbing board comprising:

a sound absorbing board body formed into a substantially flat plate;

a plurality of ribs provided on a front surface of said sound absorbing board body for reinforcing said sound absorbing board body;

a plurality of through-holes disposed at a base portion between said ribs provided in said sound absorbing board body; and concealing materials disposed on the front surface of said sound absorbing board body and concealing said through-holes;

wherein slits are formed between the concealing materials and said ribs which communicate with said through-holes.

4. A sound absorbing board as claimed in claim 3, wherein the height of an upper surface of said concealing materials is not higher than the height of an upper surface of said ribs.

5. A sound absorbing body as claimed in claim 1, wherein the height of an upper surface of said concealing materials is not higher than the height of an upper surface of said ribs.

6. A sound absorbing body as claimed in claim 1, wherein each of the concealing materials has a width which is larger than a diameter of the through-holes concealed thereby.

7. A sound absorbing body as claimed in claim 3, wherein each of the concealing materials has a width which is larger than a diameter of the through-holes concealed thereby.

8. A sound absorbing body as claimed in claim 3, wherein said slits have a sectional area between the ribs and concealing materials which is larger than a cross-sectional area of the through-holes.

9. A sound absorbing body as claimed in claim 1, wherein said slits have a sectional area between the ribs and concealing materials which is larger than a cross-sectional area of the through-holes.

* * * * *